US009281588B2

(12) United States Patent
Hashiguchi

(10) Patent No.: US 9,281,588 B2
(45) Date of Patent: Mar. 8, 2016

(54) FEMALE CONNECTOR

(71) Applicant: JAPAN AVIATION ELECTRONICS INDUSTRY, LIMITED, Shibuyaku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/576,044

(22) Filed: Dec. 18, 2014

(65) Prior Publication Data

US 2015/0180148 A1 Jun. 25, 2015

(30) Foreign Application Priority Data

Dec. 20, 2013 (JP) ..... 2013-263326

(51) Int. Cl.
*H01R 4/50* (2006.01)
*H01R 12/71* (2011.01)
*H01R 13/11* (2006.01)

(52) U.S. Cl.
CPC ..... *H01R 12/716* (2013.01); *H01R 13/11* (2013.01)

(58) Field of Classification Search
CPC ..... H01R 13/193; H01R 13/629
USPC ..... 439/342, 376, 74
See application file for complete search history.

(56) References Cited

U.S. PATENT DOCUMENTS 8,974,236 B2 * 3/2015 Terhune, IV ..... H01R 12/714 439/733.1
2002/0151203 A1 * 10/2002 Sagano ..... H01R 13/62905 439/342
2002/0192994 A1 * 12/2002 Turner ..... H01R 13/193 439/342
2004/0102074 A1 * 5/2004 Kukita ..... H01R 4/028 439/342
2004/0127085 A1 * 7/2004 Chen ..... H01R 12/57 439/342
2004/0214468 A1 * 10/2004 Chang ..... H01R 43/0256 439/342
2005/0090137 A1 * 4/2005 Gottlieb ..... H05K 1/0254 439/342

FOREIGN PATENT DOCUMENTS

JP 2012089244 A 5/2012

* cited by examiner

*Primary Examiner* — Phuong Dinh
(74) *Attorney, Agent, or Firm* — Holtz, Holtz & Volek PC

(57) ABSTRACT

A female connector downsized by downsizing female-side contacts. Each female-side contact portion is formed of a first connection portion having an arm portion extending from a base portion in a width direction, a first supporting portion integrally connected to one end of the arm portion, and a second connection portion having a second supporting portion integrally connected to the other end of the arm portion. The first and second supporting portions extend in a direction away from the arm portion, and then extend toward the central portion of the arm portion. When a male connector and the female connector are fitted, each male-side contact portion is received outside an associated female-side contact portion and then is moved inside therefrom. Then, the male-side contact portion is sandwiched by a first and second contact point portions formed respectively at the first and second point portions.

19 Claims, 27 Drawing Sheets

FEMALE CONNECTOR

BACKGROUND OF THE INVENTION

1. Field of the Invention

This invention relates to a female connector.

2. Description of the Related Art

Conventionally, there has been proposed a sheet connector comprised of a male connector and a female connector (see Japanese Laid-Open Patent Publication (Kokai) No. 2012-89244).

As shown in FIG. 26, the male connector includes a base film 9115, a conductor pattern 9151, a cover film 9117, and a frame reinforcement layer 9116. The conductor pattern 9151 is comprised of a pair of wide traces 9151A, and a large number of narrow traces 9151B. Each wide trace 9151A and each narrow trace 9151B have a reception terminal 9153, which is a plate-shaped terminal, as a female terminal.

The reception terminal 9153 is fitted on a protruding terminal, not shown, of the male connector to attain electrical conduction. The narrow traces 9151B are arranged along a left-right direction LR. The wide traces 9151A are arranged on opposite sides of a row of the narrow traces 9151B.

As shown in FIG. 27, the reception terminal 9153 includes an upper end portion 9153E1, a pair of upper base portions 9153A1 connected to the upper end portion 9153E1, a pair of upper arm portions 9153D1 connected to the pair of upper base portions 9153A1, a pair of contact portions 9153C connected to the pair of upper arm portions 9153D1, a pair of lower arm portions 9153D2 connected to the pair of contact portions 9153C, a lower base portion 9153A2 connected to the pair of lower arm portions 9153D2, and a lower end portion 9153E2 connected to the lower base portion 9153A2. An inner opening 9154A for receiving the protruding terminal of the male connector is formed between the pair of upper arm portions 9153D1.

Next, a description will be given of a procedure for fitting the male connector into the female connector.

First, the male connector and the female connector are set opposed to each other, and then the male connector is placed on the female connector. At this time, the protruding terminal of the male connector is inserted into the inner opening 9154A of the reception terminal 9153.

After that, the male connector is relatively slid with respect to the female connector along a front-rear direction FR. As a consequence, the protruding terminal of the male connector is moved in between the pair of contact portions 9153C of the reception terminal 9153. At this time, the returning forces of the pair of upper arm portions 9153D1 of the reception terminal 9153 are generated, whereby the protruding terminal of the male connector is held between the pair of contact portions 9153C of the reception terminal 9153.

Thus, the male connector is fitted into the female connector, whereby the connectors are electrically connected.

In the conventional sheet connector, a structure is employed in which when the male connector is fitted into the female connector, the protruding terminal of the male connector is inserted into a large space (inner opening 9154A) formed between the pair of upper arm portions 9153D1 of the reception terminal 9153, and is moved in between the pair of contact portions 9153C. A front end portion of the protruding terminal of the male connector is thicker than an intermediate portion of the protruding terminal, and a front end surface of the protruding terminal is a large pentagonal plane (see FIG. 1 and FIGS. 4 to 6 in Japanese Laid-Open Patent Publication (Kokai) No. 2012-89244). The inner opening 9154A of the reception terminal 9153 can smoothly receive the front end portion of the protruding terminal, and has an opening area large enough to allow the protruding terminal to move therein (see FIG. 27).

Since the reception terminal 9153 of each narrow trace 9151B is large as described above, the conventional sheet connector suffers from the problem that the female connector is increased in size.

SUMMARY OF THE INVENTION

The present invention has been made in view of these circumstances, and an object thereof is to reduce the size of a female-side contact to thereby reduce the size of a female connector.

To attain the above object, in a first aspect of the present invention, there is provided a female connector that is mounted on a first substrate, and is electrically connected to a male connector mounted on a second substrate by being relatively slid with respect to the male connector, comprising a female-side insulating film, and a plurality of female-side contacts that are provided on the female-side insulating film, and each include a base portion that is disposed on one surface of the female-side insulating film, a female-side contact portion that is disposed on the one surface of the female-side insulating film, and is integrally connected to the base portion, and a female-side terminal portion that is disposed on the other surface of the female-side insulating film, and is integrally connected to the base portion, for being connected to the first substrate, wherein the female-side contact portion includes a first connection portion having a first contact point portion that is brought into contact with an associated one of male-side contact portions of the male connector, and a second connection portion having a second contact point portion that is brought into contact with the male-side contact portion, wherein the first connection portion and the second connection portion are formed such that the first contact point portion and the second contact point portion are close to each other, respectively, to thereby make narrow a contact portion inside area formed between the first connection portion and the second connection portion, and wherein the male-side contact portion is sandwiched by the first contact point portion and the second contact point portion, when the male-side contact portion is moved in a connector sliding direction from outside the female-side contact portion to a location between the first contact point portion and the second contact point portion.

Preferably, a direction in which the male-side contact portion is sandwiched by the first contact point portion and the second contact point portion is an intersecting direction intersecting at right angles with the connector sliding direction and a thickness direction of the female-side insulating film.

Preferably, a direction in which the male-side contact portion is sandwiched by the first contact point portion and the second contact point portion is an intersecting direction intersecting obliquely with the connector sliding direction and a thickness direction of the female-side insulating film.

More preferably, when the male-side contact portion is sandwiched by the first contact point portion and the second contact point portion, the male-side contact portion, the first contact point portion, the second contact point portion, and the base portion are aligned in the intersecting direction.

More preferably, the first connection portion has an arm portion that extends from the base portion in the intersecting direction, and a first supporting portion that is integrally connected to one end of the arm portion, and extends in a direction away from the arm portion, thereafter extending toward a central portion of the arm portion, the first contact point portion is formed at the first supporting portion, the second connection portion has a second supporting portion that is integrally connected to the other end of the arm portion, and extends in a direction away from the arm portion, thereafter extending toward the central portion of the arm portion, and the second contact point portion is formed at the second supporting portion.

More preferably, the first connection portion has an arm portion that extends in the intersecting direction from one end of the base portion in the connector sliding direction, and a first supporting portion that is integrally connected to one end of the arm portion, and extends in a direction away from the arm portion, the first contact point portion is formed at the first supporting portion, the second connection portion has a second supporting portion that extends toward the arm portion from the other end of the base portion in the connector sliding direction, and the second contact point portion is formed at the second supporting portion.

Further preferably, a guiding portion is formed at the first supporting portion, for guiding the male-side contact portion in between the first contact point portion and the second contact point portion when the male-side contact portion is moved in the connector sliding direction from outside the female-side contact portion to a location between the first contact point portion and the second contact point portion.

Preferably, the female-side insulating film has a through hole that receives the male-side contact portion, and the male-side contact portion is inserted into the through hole.

Preferably, when the male-side contact portion is sandwiched by the first contact point portion and the second contact point portion, the female-side contact portion is sandwiched by a front end portion, which is made thicker, of the male-side contact portion and the male-side insulating film of the male connector in a thickness direction of the female-side insulating film.

More preferably, the female-side contact portion has an inclined surface that forms a receiving space for the front end portion of the male-side contact portion when the male-side contact portion is sandwiched by the first contact point portion and the second contact point portion.

To attain the above object, in a second aspect of the present invention, there is provided a method of manufacturing the female connector, comprising a thin film-processing step of providing a metal thin film on one surface of the female-side insulating film, a patterning step of forming a plurality of the female-side contact portions and a plurality of the base portions by etching the metal thin film on the one surface of the female-side insulating film, after execution of the thin film-processing step, a cutout and through hole-forming step of forming cutouts reaching the base portions in the female-side insulating film and the through holes, by etching processing, after execution of the patterning step, and a terminal portion-forming step of forming a plurality of the female-side terminal portions at respective locations corresponding to the cutouts on the other surface of the female-side insulating film, after execution of the cutout and through hole-forming step.

According to the present invention, it is possible to reduce the size of contacts to thereby reduce the size of a connector.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
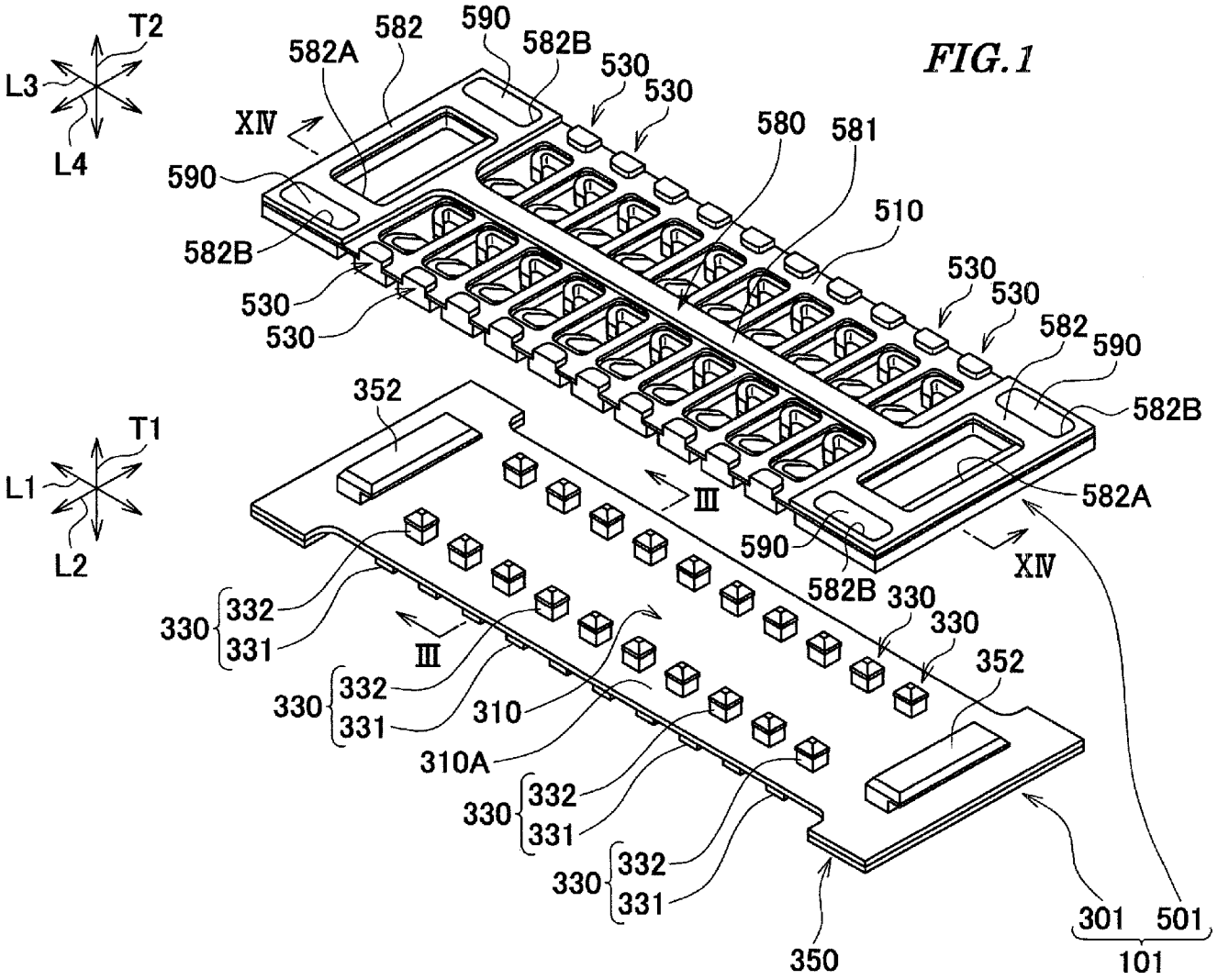
FIG. 1 is a perspective view of a board-to-board connector which is comprised of a female connector according to a first embodiment of the present invention and a male connector, in a state before the male connector is fitted into the male connector.
Figure 2:
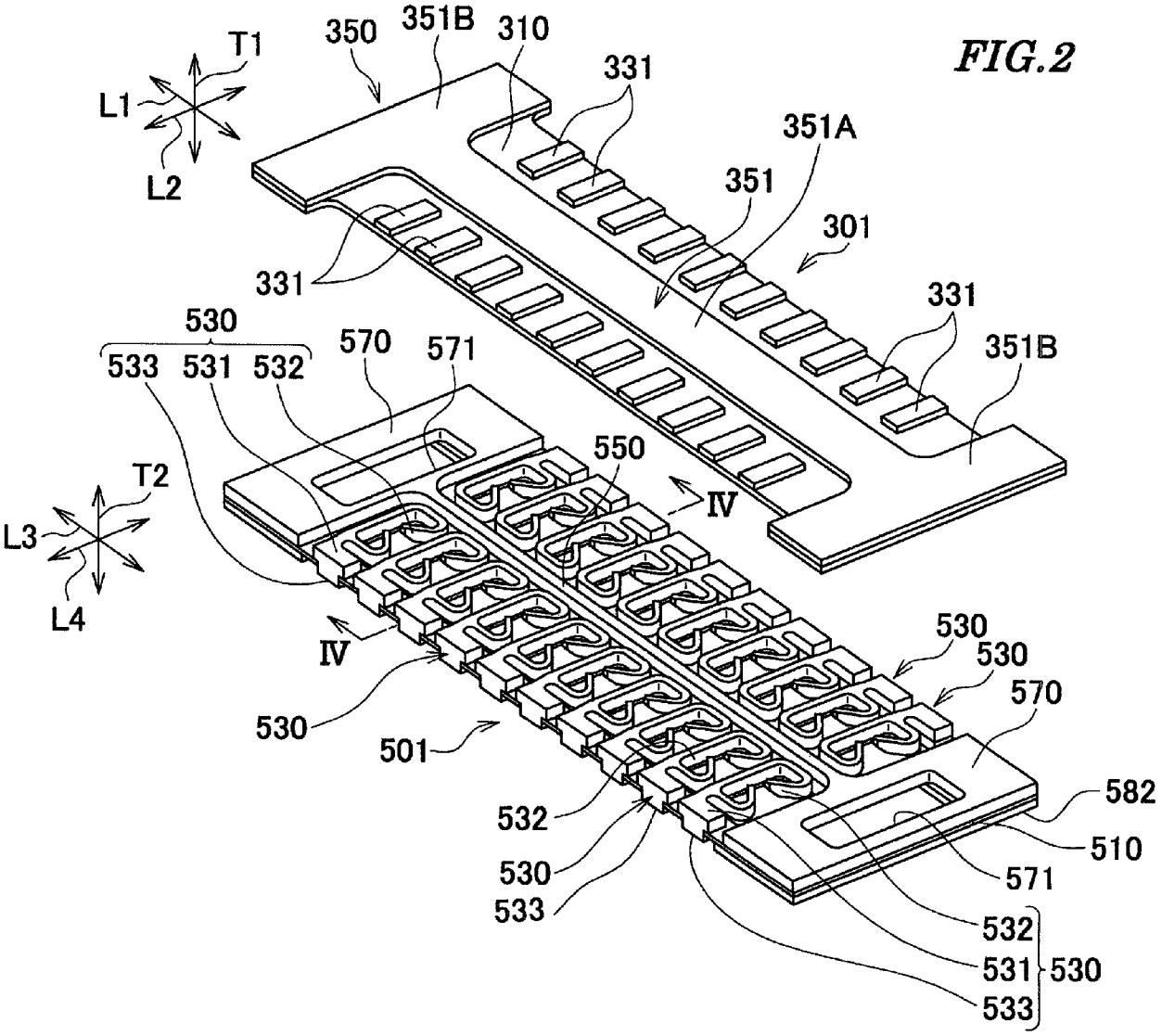
FIG. 2 is a perspective view of the board-to-board connector shown in FIG. 1, as viewed from another angle.

As shown in FIGS. 1 and 2, a female connector 501 according to a first embodiment of the present invention forms a board-to-board connector 101 in combination with a male connector 301 mounted on a second circuit board (second substrate) not shown. The female connector 501 is mounted on a first circuit board (first substrate) not shown. The board-to-board connector 101 electrically connects the first circuit board and the second circuit board, which are arranged opposed to each other.

First, before the female connector 501 is described, a description will be given of the male connector 301. The male connector 301 can be relatively fitted to and removed from the female connector 501 in a thickness direction T2 of a female-side insulating film 510 of the female connector 501.

Figure 3:
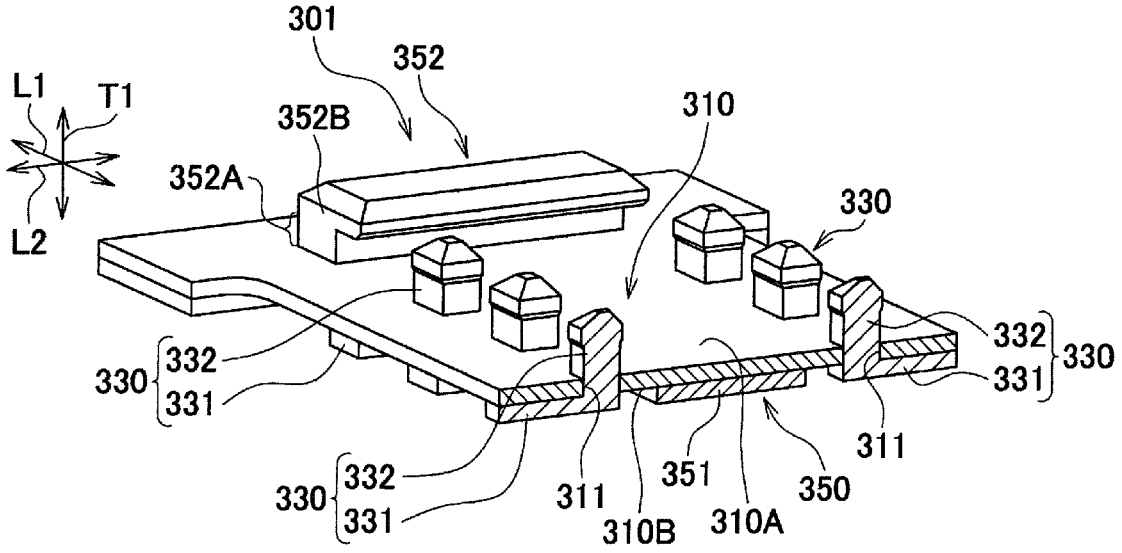
FIG. 3 is a perspective view of the male connector appearing in FIG. 1, in a state cut along III-III in FIG. 1.

As shown in FIGS. 1, 2, and 3, the male connector 301 includes a male-side insulating film 310, a plurality of male-side contacts 330 provided on the male-side insulating film 310, and a male-side reinforcing member 350 provided on the male-side insulating film 310.

The male-side insulating film 310 is belt-shaped. The material of the male-side insulating film 310 is e.g. resin, such as polyimide.

Each male-side contact 330 includes a male-side terminal portion 331 that is soldered to a pad (not shown) of the second circuit board, and a prism-shaped (pin-shaped) male-side contact portion 332 that is integrally connected to the male-side terminal portion 331 and protrudes from one surface 310A of the male-side insulating film 310. The male-side contact portion 332 is brought into contact with a female-side contact portion 532 of a female-side contact 530 of the female connector 501. The material of the male-side terminal portion 331 and the male-side contact portion 332 is e.g. copper or copper alloy.

The male-side contact portion 332 is formed such that a front end portion thereof is thicker than the other portion (see FIG. 3). A plurality of the male-side contact portions 332 are arranged in two rows on the one surface 310A of the male-side insulating film 310. A direction of arrangement of the plurality of male-side contact portions 332 is parallel to a longitudinal direction L1 of the male-side insulating film 310. The plurality of male-side terminal portions 331 are arranged in two rows on the other surface 310B of the male-side insulating film 310. A direction of arrangement of the plurality of male-side terminal portions 331 is parallel to the longitudinal direction L1 of the male-side insulating film 310.

The male-side reinforcing member 350 includes a male-side reinforcing member main body 351 having an H-shaped planar shape and protruding portions 352. The male-side reinforcing member main body 351 includes a male-side reinforcing member main body portion 351A and fixing portions 351B which are continuous with opposite ends of the male-side reinforcing member main body portion 351A, respectively. The protruding portions 352 are integrally connected to the fixing portions 351B. The male-side reinforcing member main body portion 351A is arranged along the plurality of male-side terminal portions 331 (see FIGS. 2 and 9). The fixing portions 351B are arranged on opposite ends of the other surface 310B of the male-side insulating film 310. The protruding portions 352 are arranged on opposite ends of the one surface 310A of the male-side insulating film 310. The male-side reinforcing member main body portion 351A is belt-shaped and is arranged between the two rows of the male-side terminal portions 331. The male-side reinforcing member main body 351 is formed of the same material as that of the male-side terminal portions 331 and is formed simultaneously with formation of the male-side terminal portions 331, as will be described hereinafter. Each protruding portion 352 includes a protruding portion main body 352A in the form of a rectangular parallelepiped, and a holding portion 352B which is continuous with an end of the protruding portion main body 352A (see FIG. 3). A vertical cross-section of each protruding portion 352 is hook-shaped. The material of the protruding portions 352 is the same as that of the male-side contact portions 332, and the protruding portions 352 are formed simultaneously with formation of the male-side contact portions 332.

Next, a description will be given of the female connector 501 according to the first embodiment of the present invention.

Figure 4:
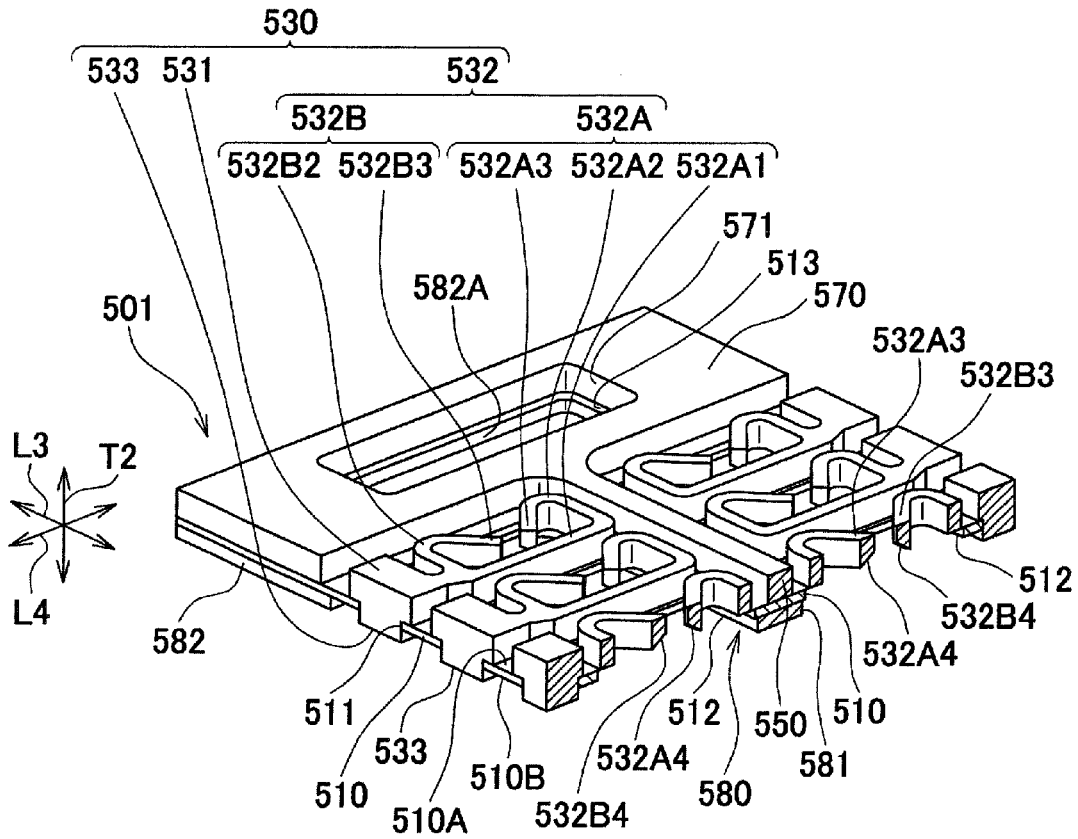
FIG. 4 is a perspective view of the female connector appearing in FIG. 2, in a state cut along IV-IV in FIG. 2.

As shown in FIGS. 1, 2, and 4, the female connector 501 includes the female-side insulating film 510 which is belt-shaped, a plurality of the female-side contacts 530 provided on the female-side insulating film 510, a first female-side reinforcing member 550 formed on one surface 510A of the female-side insulating film 510, protruding portion-supporting members 570 each having a protruding portion-receiving hole 571 which guides an associated one of the protruding portions 352 of the male connector 301 toward the first circuit board, a second female-side reinforcing member 580 attached to the other surface 510B of the female-side insulating film 510, and holddowns 590 formed on the other surface 510B of the female-side insulating film 510.

The female-side insulating film 510 has a plurality of cutouts 511, a plurality of through holes 512 which are holes formed through the female-side insulating film 510, and a pair of through holes 513. The plurality of cutouts 511 are arranged in two rows in a longitudinal direction L3 of the female-side insulating film 510 (connector sliding direction) (see FIG. 4). The plurality of through holes 512 are formed in two rows in the longitudinal direction L3. The two rows of the through holes 512 are sandwiched by the two rows of the cutouts 511 in a width direction L4 of the female-side insulating film 510 (intersecting direction). The through holes 512 receives at least the front end portions of the male-side contact portions 332, respectively, when the male connector 301 and the female connector 501 are fitted to each other, whereas when the male connector 301 and the female connector 501 are released from the fitted state, the through holes 512 restrict movement of the male-side contact portion 332 in the longitudinal direction L3. The pair of through holes 513 are formed through the opposite ends of the female-side insulating film 510 in the longitudinal direction L3. The through holes 513 and through holes 582A of fixing portions 582, referred to hereinafter, are opposed to each other.

Each female-side contact 530 includes a base portion 531 that is disposed on the one surface 510A of the female-side insulating film 510, the female-side contact portion 532 that is disposed on the one surface 510A of the female-side insulating film 510 and is integrally connected to the base portion 531, for being brought into contact with an associated one of the male-side contact portions 332, and a female-side terminal portion 533 that is disposed on the other surface 510B of the female-side insulating film 510 and is integrally connected to the base portion 531, for being soldered to a pad (not shown) of the second circuit board. The female-side insulating film 510 is formed of the same material as that of the male-side insulating film 310. The base portions 531, the female-side contact portions 532, and the female-side terminal portions 533 are formed of e.g. copper or copper alloy.

The plurality of female-side contact portions 532 are arranged in two rows on the one surface 510A of the female-side insulating film 510. A direction of arrangement of the plurality of female-side contact portions 532 is parallel to the longitudinal direction L3. The plurality of female-side terminal portions 533 are arranged in two rows on the other surface 510B of the female-side insulating film 510. A direction of arrangement of the plurality of female-side terminal portions 533 is parallel to the longitudinal direction L3. The plurality of base portions 531 are arranged in two rows on the one surface 510A of the female-side insulating film 510. A direction of arrangement of the plurality of base portions 531 is parallel to the longitudinal direction L3.

The first female-side reinforcing member 550 has a long and narrow shape, and is located between the two rows of the female-side contact portions 532. The first female-side reinforcing member 550 connects the two protruding portion-supporting members 570 in a manner continuous therewith.

The protruding portion-supporting members 570 are arranged on the opposite end portions of the one surface 510A of the female-side insulating film 510.

The second female-side reinforcing member 580 is a metallic plate (e.g. stainless steel plate), and has an H-shaped planar shape. The second female-side reinforcing member 580 includes one second female-side reinforcing member main body 581 and the two fixing portions 582. The second female-side reinforcing member main body 581 connects the two fixing portions 582 in a manner continuous therewith. The fixing portions 582 are arranged on the opposite end portions of the other surface 510B of the female-side insulating film 510. Each fixing portion 582 has the one through hole 582A and two through holes 582B. The through hole 582A receives an associated one of the holding portions 352B when the male connector 301 is fitted to the female connector 501. Each through hole 582B is formed with the holddown 590. A front end surface of the holddown 590 and the surface of the fixing portion 582 are positioned substantially on the same plane.

The length of the protruding portion-receiving hole 571 (see FIG. 4) and the through hole 582A in the width direction L4 of the female-side insulating film 510 is slightly larger than the length of the protruding portion 352 (see FIG. 3) in a width direction L2 of the male-side insulating film 310. The length of the protruding portion-receiving hole 571 in the longitudinal direction L3 is slightly larger than the length of the holding portion 352B (see FIG. 3) in the longitudinal direction L1. Further, the through hole 513 (see FIG. 4) is equal to the through hole 582A in length in the longitudinal direction L3 of the female-side insulating film 510. A difference in length between the through hole 582A and the protruding portion-receiving hole 571 in the longitudinal direction L3 is approximately equal to a difference in length between the holding portion 352B and the protruding portion main body 352A in the longitudinal direction L1 (see FIG. 3). The above-mentioned dimensional relationship makes it possible to relatively fit and remove the male connector 301 to and from the female connector 501 in the thickness direction T2, and relatively slide the male connector 301 in the longitudinal direction L3, with respect to the female connector 501, from the protruding portion insertion completion position (see FIGS. 15 to 19) in which the protruding portions 352 have been inserted in the protruding portion-receiving holes 571, to the sliding completion position (see FIGS. 20 to 23) in which a predetermined contact force is generated between the male-side contact portions 332 and the female-side contact portions 532. Further, when the male connector 301 has been slid from the protruding portion insertion completion position to the sliding completion position, the holding portions 352B of the protruding portions 352 are hooked to the protruding portion-supporting members 570, respectively, whereby the male connector 301 is locked in the thickness direction T2.

Figure 5:
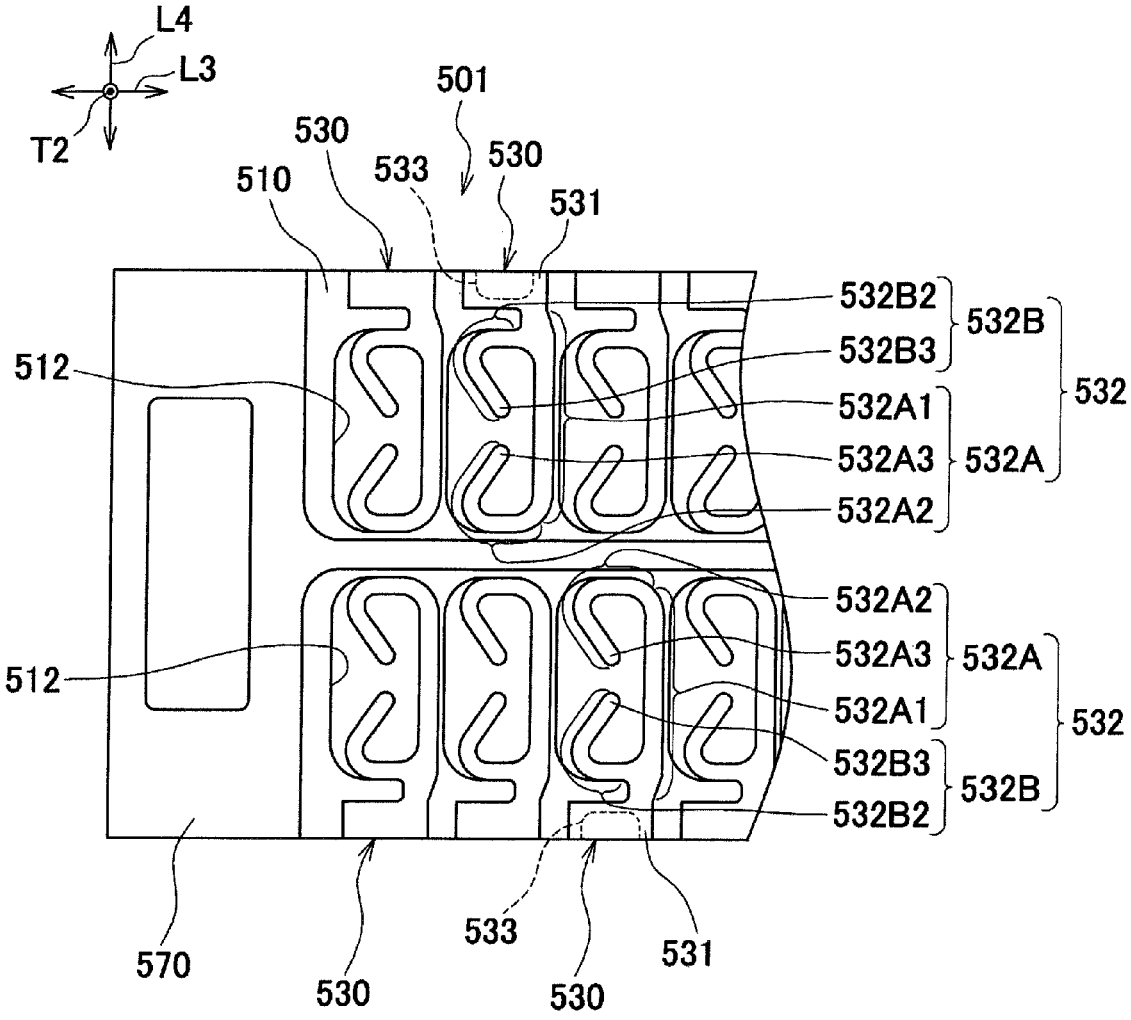
FIG. 5 is a partial plan view of the female connector appearing in FIG. 1, as viewed from a fitting surface side thereof.
Figure 15:
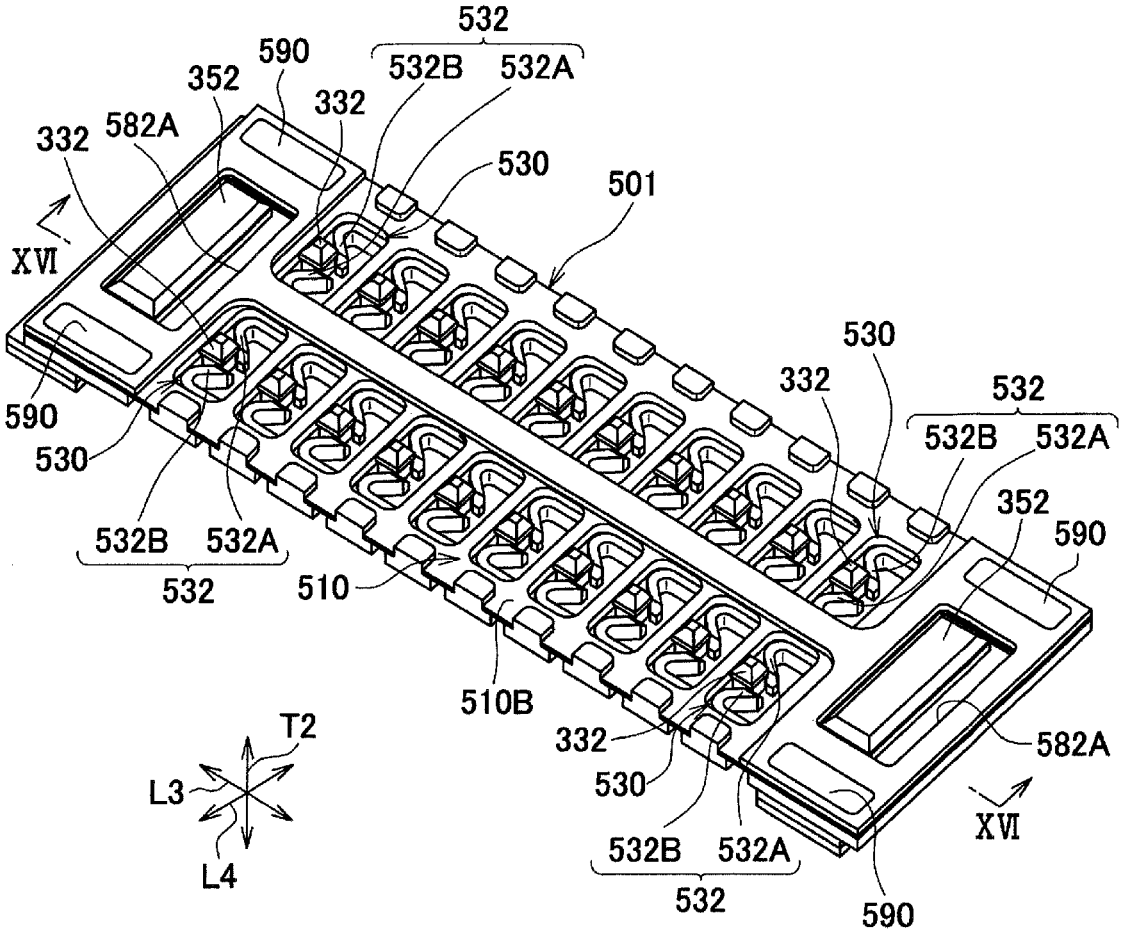
FIG. 15 is a perspective view of the male connector and the female connector in a state in which the male connector has been fitted into the female connector and the male connector is in a protruding portion insertion completion position.
Figure 17:
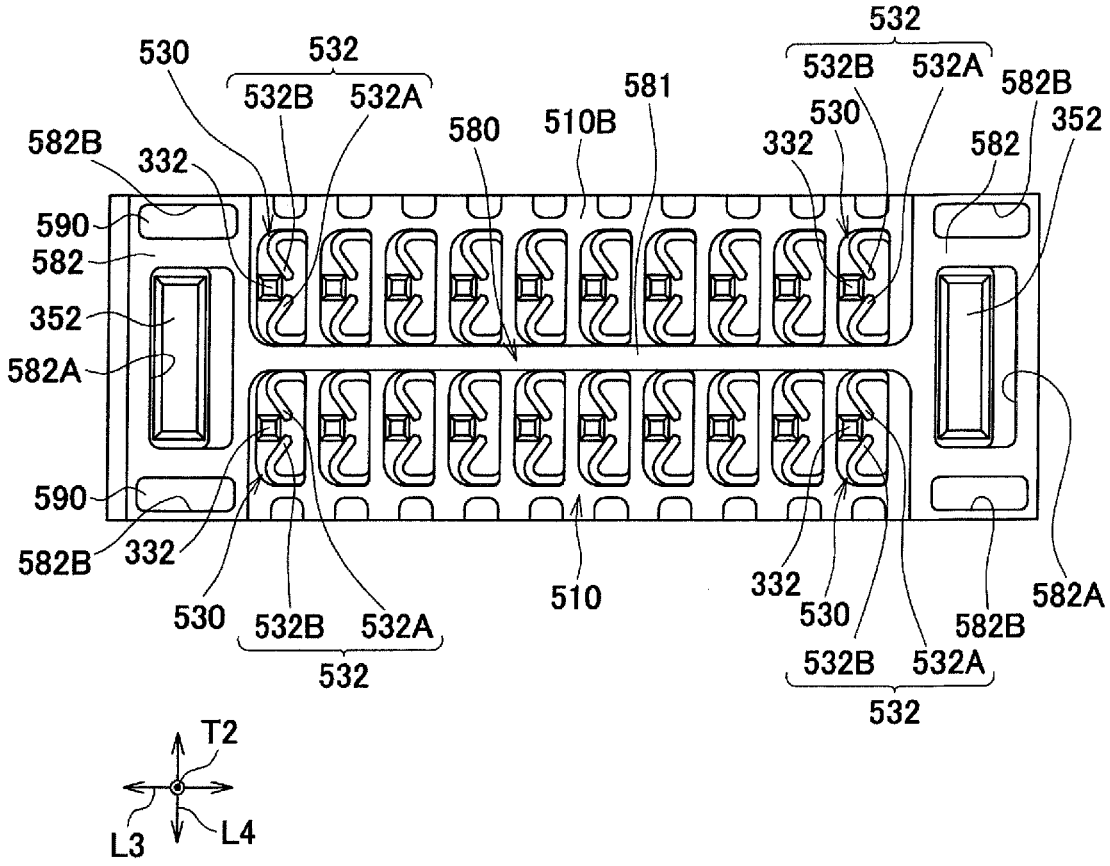
FIG. 17 is a view of the board-to-board connector shown in FIG. 15, as viewed from a mounting surface side of the female connector.
Figure 18:
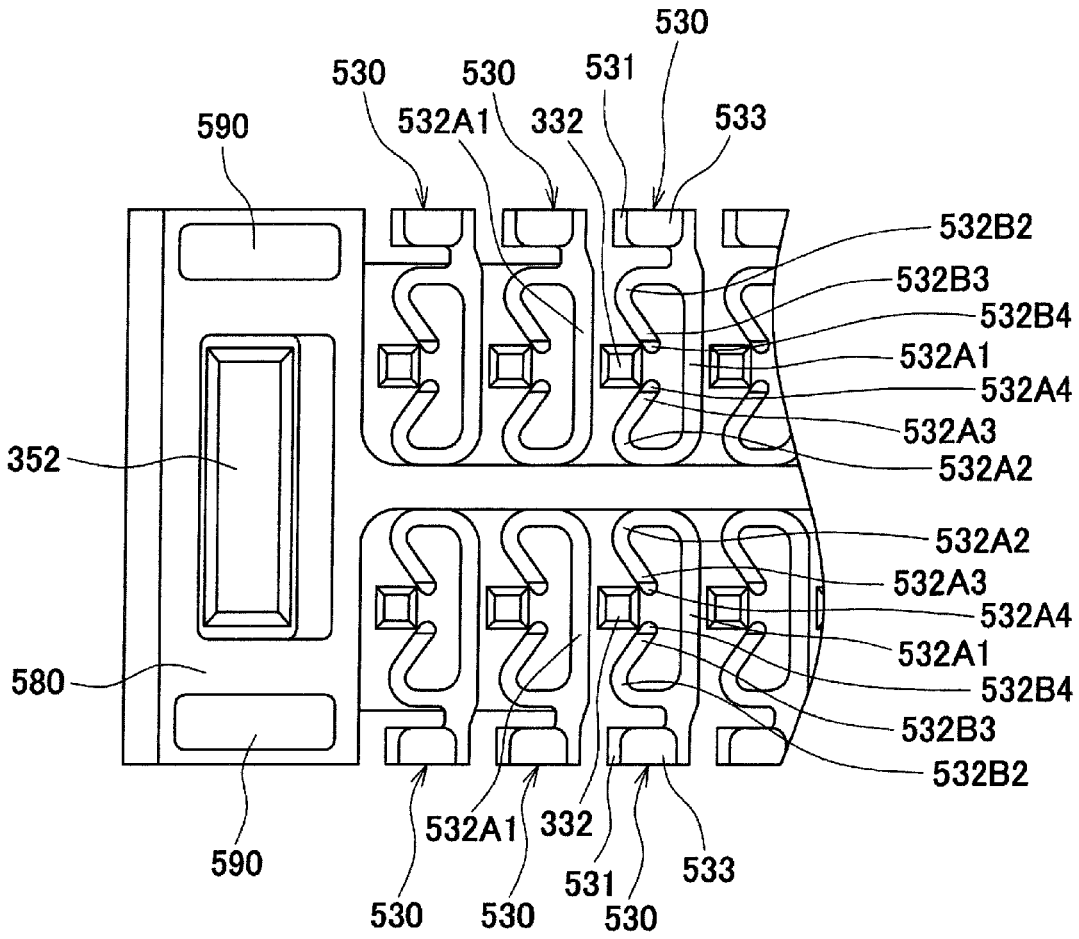
FIG. 18 is a partial plan view of the board-to-board connector shown in FIG. 17, in a state in which the male-side insulating film has been removed from the female connector, as viewed from the mounting surface side of the female connector.
Figure 19:
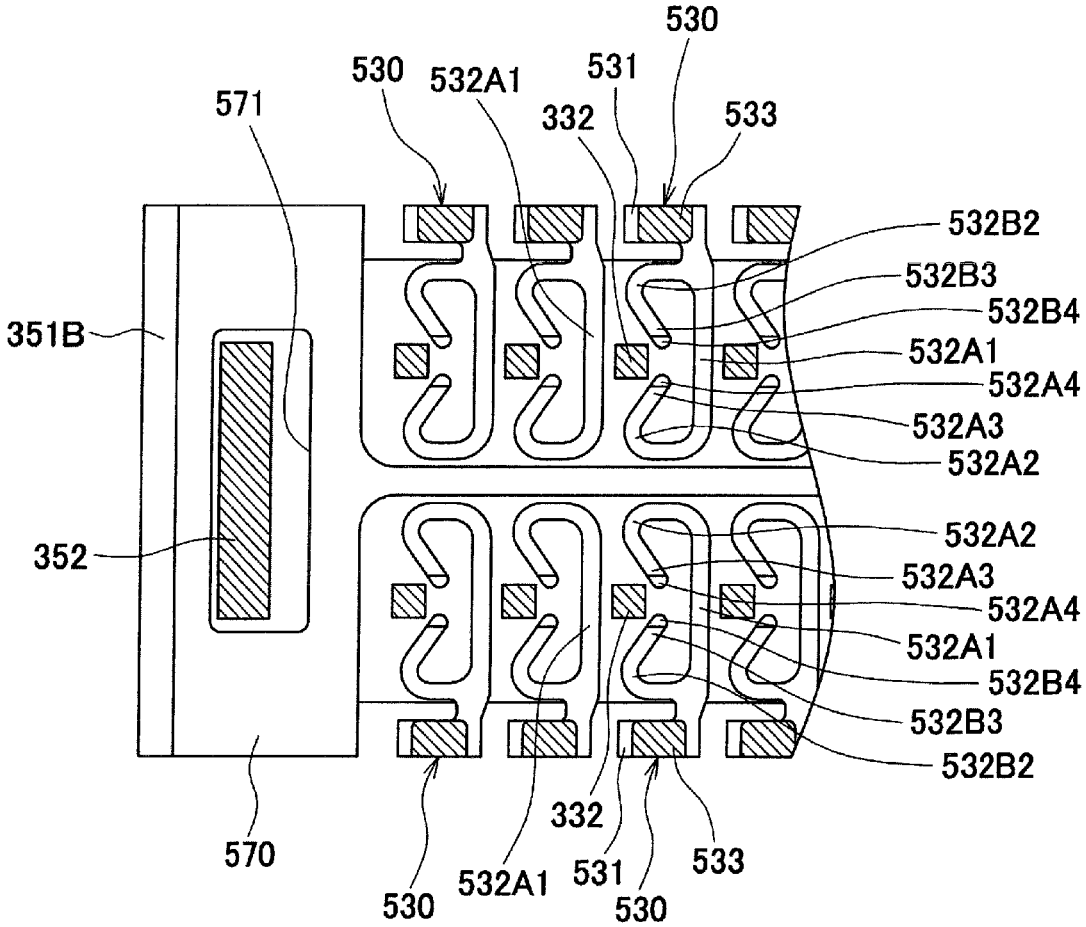
FIG. 19 is a cross-sectional view of the board-to-board connector shown in FIG. 17, in a state in which the board-to-board connector has been cut along a boundary plane between female-side terminal portions and the female-side insulating film of the female connector, as viewed from the mounting surface side of the female connector.
Figure 20:
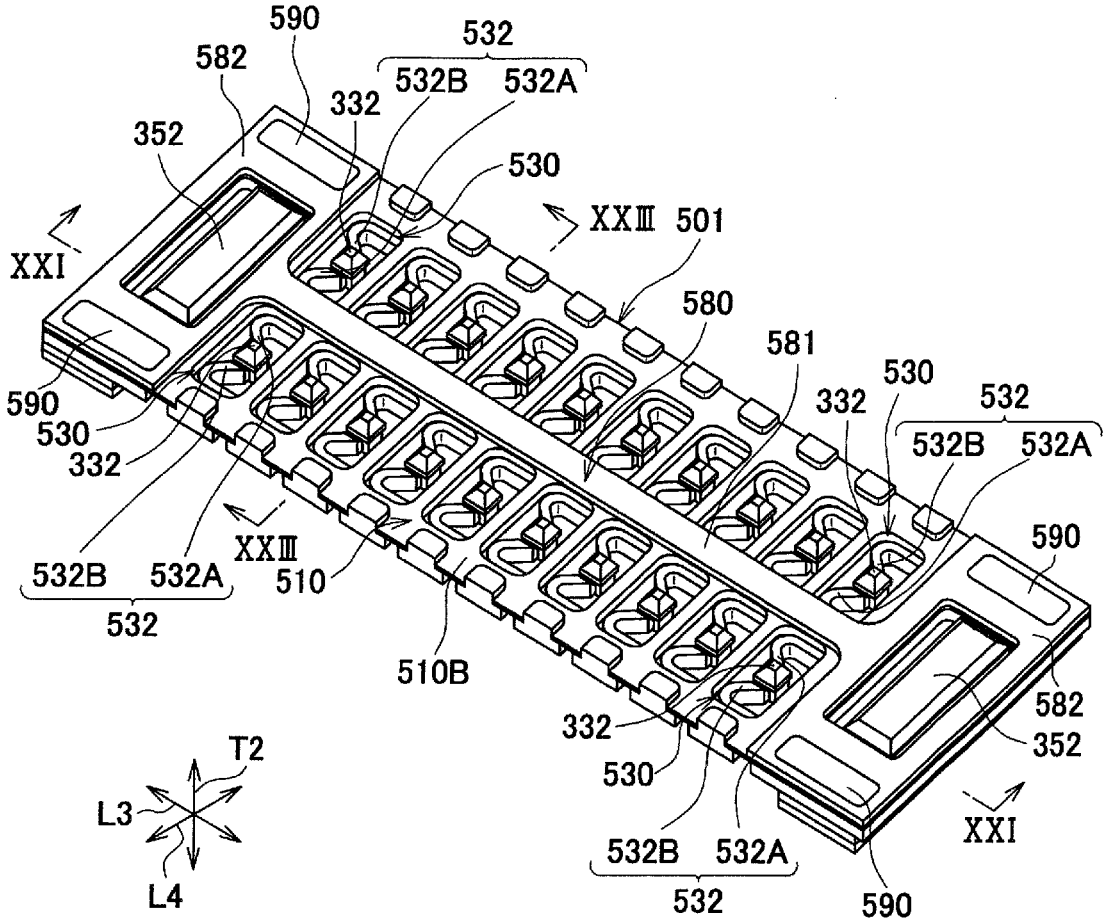
FIG. 20 is a perspective view of the board-to-board connector in a state in which the male connector has been slid from the protruding portion insertion completion position to a sliding completion position.
Figure 21:
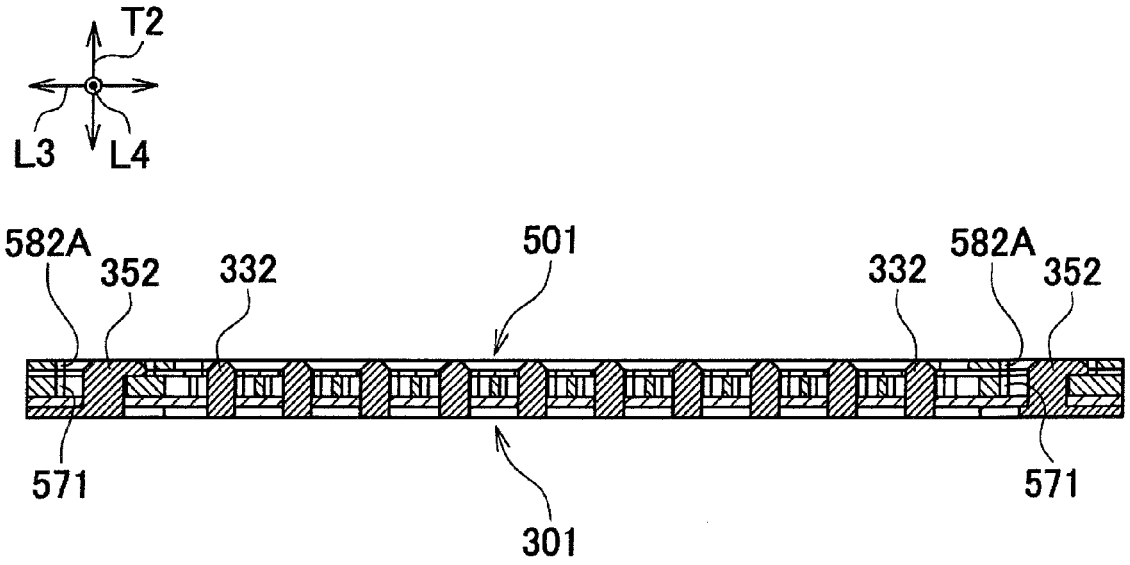
FIG. 21 is a cross-sectional view taken along XXI-XXI in FIG. 20, with the shape of the front ends of the male-side contacts illustrated in a simplified manner.
Figure 22:
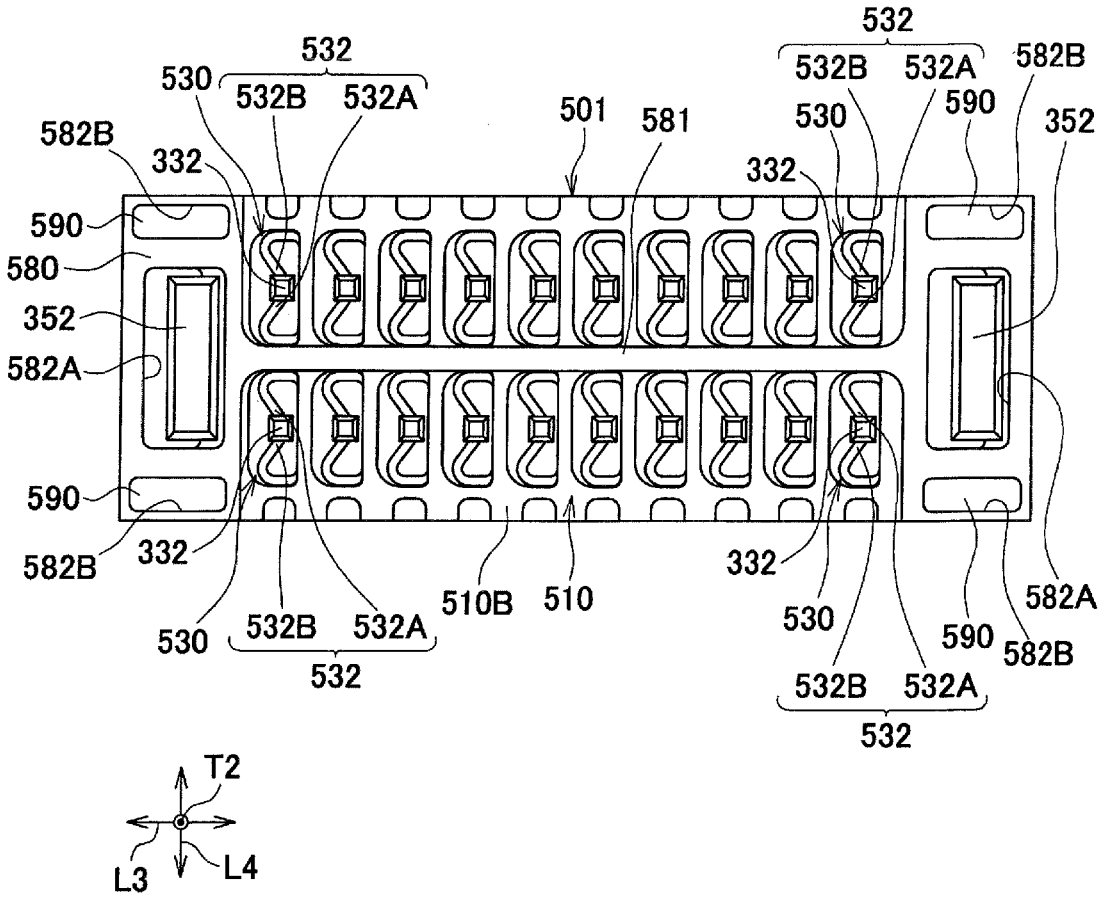
FIG. 22 is a view of the board-to-board connector shown in FIG. 20, as viewed from the mounting surface side of the female connector.

Each female-side contact portion 532 includes a first connection portion 532A and a second connection portion 532B (see FIGS. 15 and 17). As shown in FIGS. 4 and 5, the first connection portion 532A has an arm portion 532A1 extending from an associated one of the base portions 531 in the width direction L4, a first supporting portion 532A2 that is integrally connected to one end of the arm portion 532A1, and extends in a direction away from the arm portion 532A1, thereafter extending toward a central portion of the arm portion 532A1, and a first contact point portion 532A3 formed on a free end of the first supporting portion 532A2. The second connection portion 532B has a second supporting portion 532B2 that is integrally connected to the other end of the arm portion 532A1, and extends in a direction away from the arm portion 532A1, thereafter extending toward the central portion of the arm portion 532A1, and a second contact point portion 532B3 formed on a free end of the second supporting portion 532B2. The female-side contact portion 532 having the described-above structure is employed, and hence it is possible to narrow a space formed between the first and second connection portions 532A and 532B (contact portion inside area). Further, the first contact point portion 532A3 and the second contact point portion 532B3 sandwich an associated one of the male-side contact portions 332 of the male connector 301 at the sliding completion position in the width direction L4. The female-side terminal portion 533 extends through the cutout 511 of the female-side insulating film 510 such that it is integrally connected to the base portion 531 (see FIG. 23). The first contact point portion 532A3 of the first connection portion 532A has an inclined surface 532A4 formed on a surface thereof toward the female-side insulating film 510, and the second contact point portion 532B3 of the second connection portion 532B has an inclined surface 532B4 formed on a surface thereof toward the female-side insulating film 510 (see FIG. 23). The inclined surfaces 532A4 and 532B4 form a receiving space for the front end of the male-side contact portion 332 when the male connector 301 is in the sliding completion position shown in FIG. 23, and hence it is possible to maintain a state of the male connector 301 and the female connector 501 locked to each other without increasing a dimension of the board-to-board connector 101 in a fitting direction (direction parallel to a thickness direction T1 of the male-side insulating film 310), compared with first and second supporting portions (not shown) which are not formed with the inclined surfaces 532A4 and 532B4. Note that although the inclined surfaces 532A4 and 532B4 are formed such that they do not interfere with the front end of the male-side contact portion 332 of the male connector 301 which is in the sliding completion position, a configuration may be employed in which the inclined surfaces 532A4 and 532B4 are brought into contact with the front end of the male-side contact portion 332.

Next, a description will be given of an example of a method of manufacturing the male connector 301 with reference to FIGS. 6 to 13.

Figure 6:
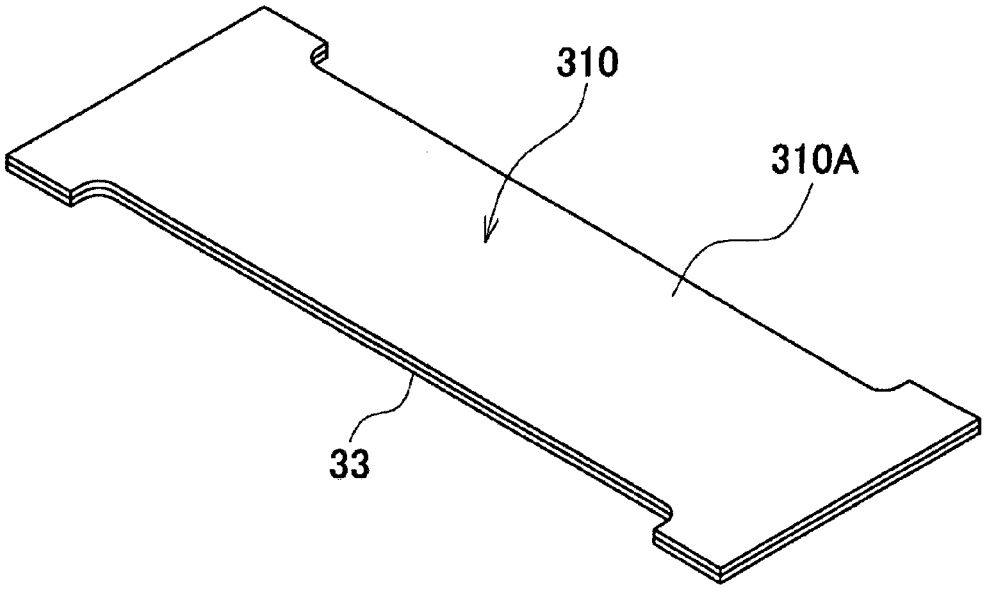
FIG. 6 is a perspective view of a male-side insulating film on which a thin film-processing step has been executed.
Figure 7:
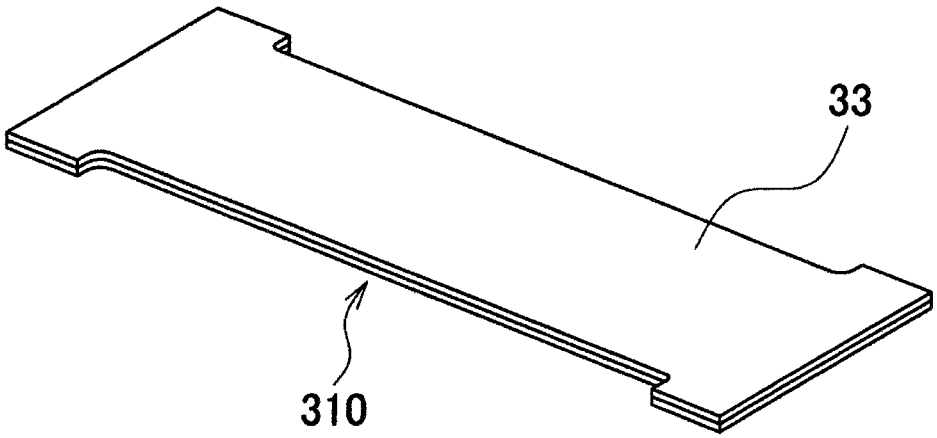
FIG. 7 is a perspective view showing a metal thin film formed on the other surface of the male-side insulating film shown in FIG. 6.

First, as shown in FIGS. 6 and 7, a metal thin film 33 is formed on the other surface 310B of the male-side insulating film 310 (thin film-processing step). Methods of forming a thin film include spattering, evaporation coating, and plating. The methods further include one in which the metal thin film 33 formed in advance is affixed to the other surface 310B of the male-side insulating film 310.

Figure 8:
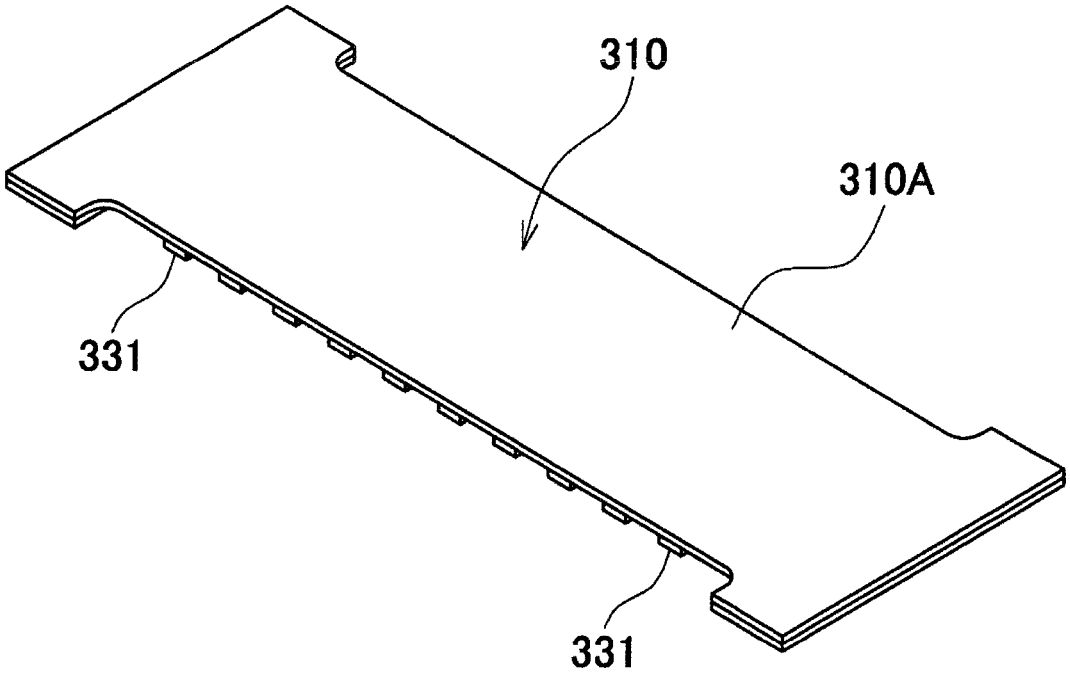
FIG. 8 is a perspective view of the male-side insulating film on which a patterning step has been executed.
Figure 9:
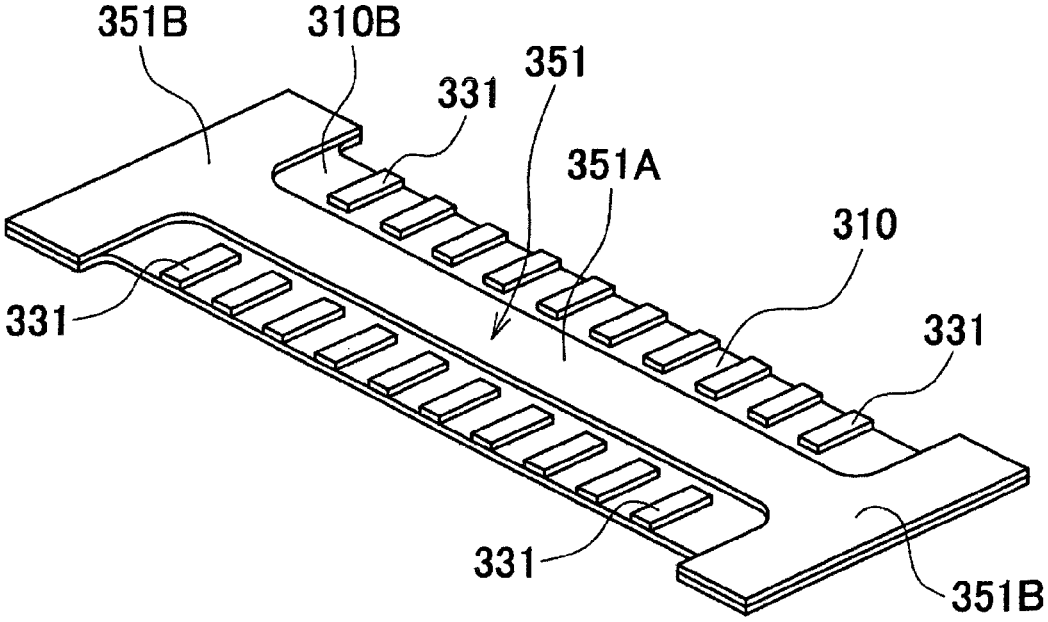
FIG. 9 is a perspective view showing male-side terminal portions formed on the other surface of the male-side insulating film shown in FIG. 8 and a male-side reinforcing member main body.

After execution of the thin film-processing step, the metal thin film 33 is etched to thereby form the plurality of male-side terminal portions 331, the male-side reinforcing member main body portion 351A, and the fixing portions 351B, as shown in FIGS. 8 and 9 (patterning step).

Figure 10:
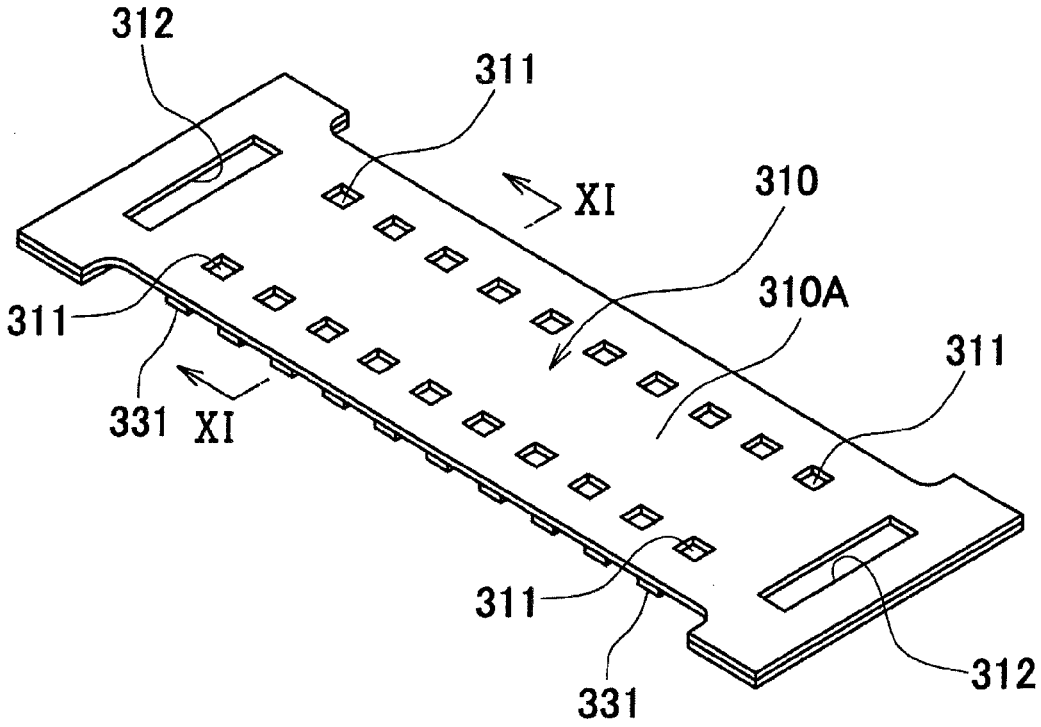
FIG. 10 is a perspective view showing one surface of the male-side insulating film on which a through hole-forming step has been executed.
Figure 11:
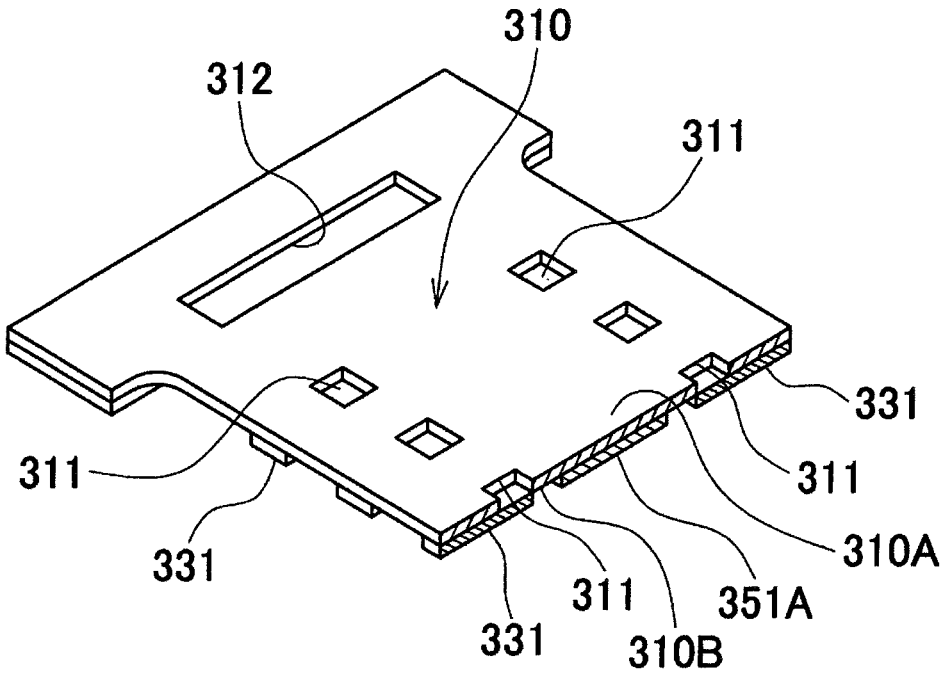
FIG. 11 is a perspective view of the male connector which is being made, in a state cut along XI-XI in FIG. 10.

After execution of the pattering step, as shown in FIGS. 10 and 11, rectangular through holes 311 which reach the male-side terminal portions 331 are formed through the male-side insulating film 310 by etching processing (through hole-forming step). At this time, rectangular through holes 312 which reach the fixing portions 351B are simultaneously formed.

Figure 12:
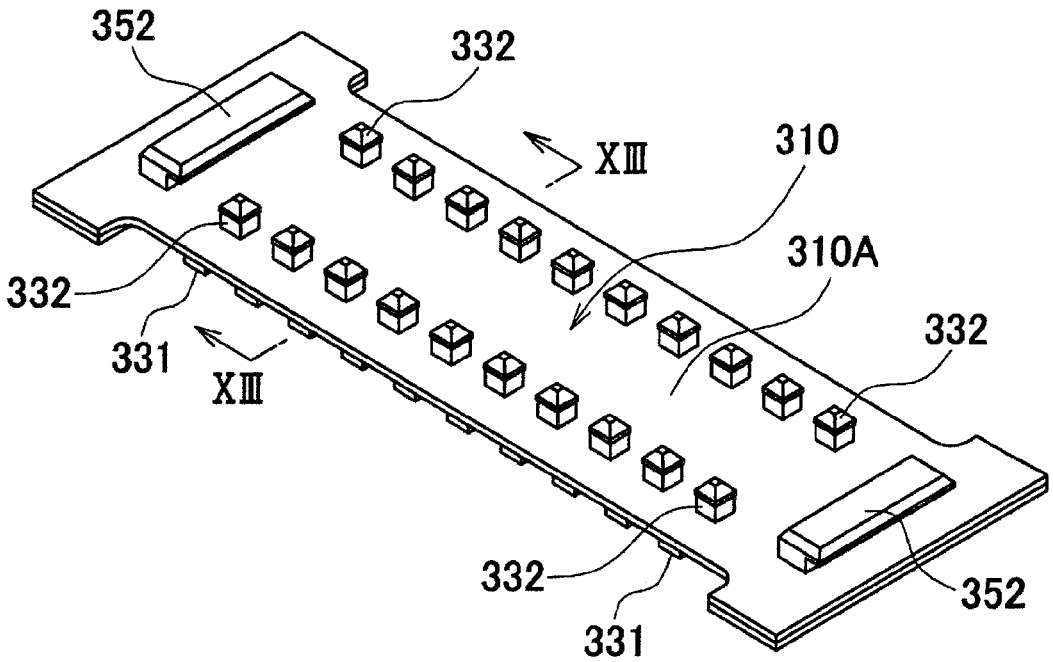
FIG. 12 is a perspective view of the male connector in a state in which male-side contact portions and protruding portions are formed on the one surface of the male-side insulating film on which a contact portion-forming step has been executed.
Figure 13:
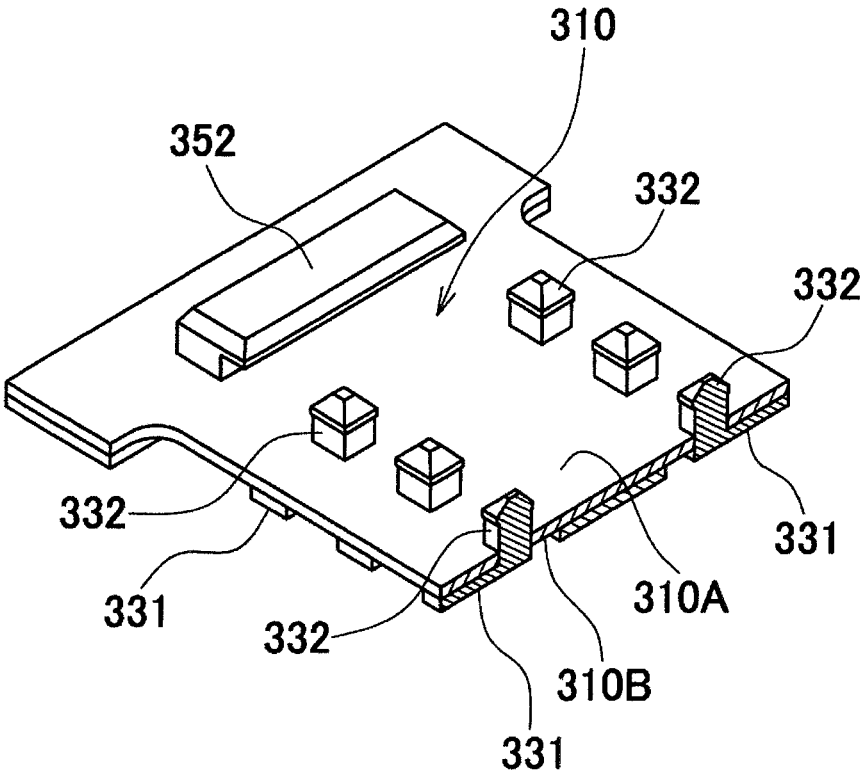
FIG. 13 is a perspective view of the male connector shown in FIG. 12, in a state cut along XIII-XIII in FIG. 12.

After execution of the through hole-forming step, as shown in FIGS. 12 and 13, there are formed on the one surface 310A of the male-side insulating film 310, the prism-shaped male-side contact portions 332 at respective locations corresponding to the through holes 311, and the protruding portions 352 at respective locations corresponding to the through holes 312. Methods of forming the male-side contact portions 332 and the protruding portions 352 include a plating method for forming objects having predetermined shaped by laminating a plurality of plated layers.

By thus executing the above-described steps, the male connector 301 is manufactured.

Next, a description will be given of an example of a method of manufacturing the female connector 501 with reference to FIGS. 1, 2, and 4.

First, a metal thin film is formed on the one surface 510A of the female-side insulating film 510 (thin film-processing step).

After execution of the thin film-processing step, the metal thin film on the one surface 510A of the female-side insulating film 510 is etched to thereby form the plurality of female-side contact portions 532, the plurality of base portions 531, the protruding portion-supporting members 570, and the first female-side reinforcing member 550 (patterning step).

After execution of the pattering step, the cutouts 511, the through holes 512, the through holes 513, and holddown-forming through holes (not shown) are formed through the female-side insulating film 510 by etching processing (cutout and through hole-forming step). The cutouts 511 reach the base portions 531, and the through holes 512 reach the female-side contact portions 532.

After execution of the cutout and through hole-forming step, there are formed on the other surface 510B of the female-side insulating film 510, the female-side terminal portions 533 at respective locations corresponding to the cutouts 511, and the holddowns 590 at respective locations corresponding to the holddown-forming through holes (terminal portion-forming step).

After execution of the terminal portion-forming step, the second female-side reinforcing member 580 having the through holes 582A and the through holes 582B is affixed to the other surface 510B of the female-side insulating film 510 (affixing step). In doing this, the second female-side reinforcing member 580 is affixed such that the holddowns 590 are accommodated in the through holes 582B, respectively.

After execution of the affixing step, the inclined surfaces 532A4 and 532B4 are formed by crushing the portion of the first contact point portion 532A3 of the first connection portion 532A toward the female-side insulating film 510, and the portion of the second contact point portion 532B3 of the second connection portion 532B toward the female-side insulating film 510, by press processing (inclined surface-forming step).

The female connector 501 is thus manufactured by execution of the above-described steps.

Next, a description will be given of an operation for fitting the female connector 501 and the male connector 301 with reference to FIG. 1 and FIGS. 14 to 23.

Figure 14:
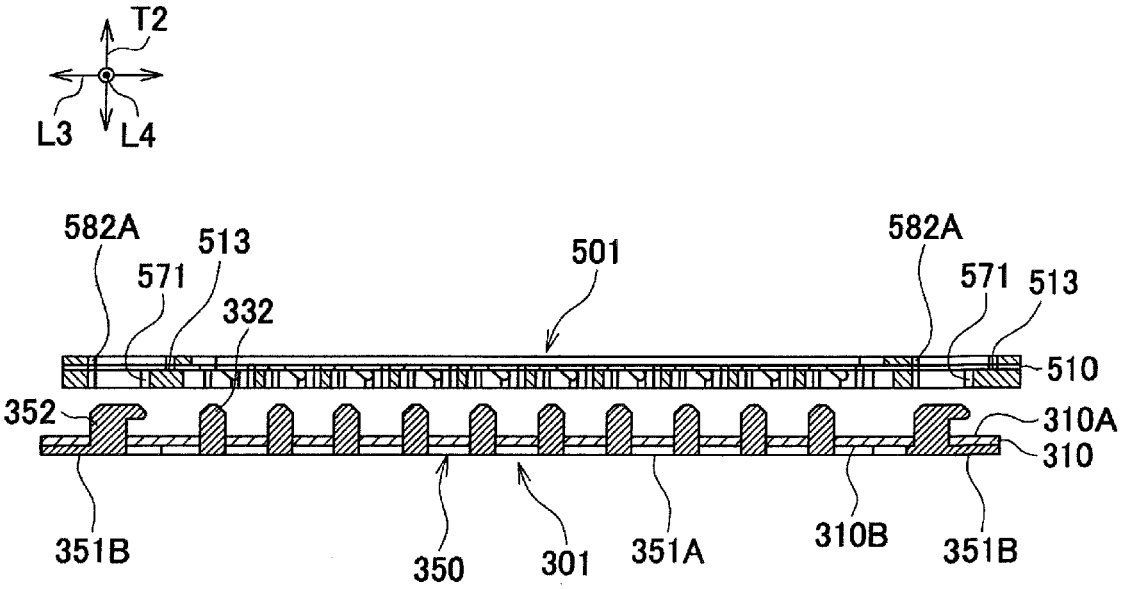
FIG. 14 is a cross-sectional view taken along XIV-XIV in FIG. 1, with the shape of front ends of male-side contacts illustrated in a simplified manner.
Figure 16:
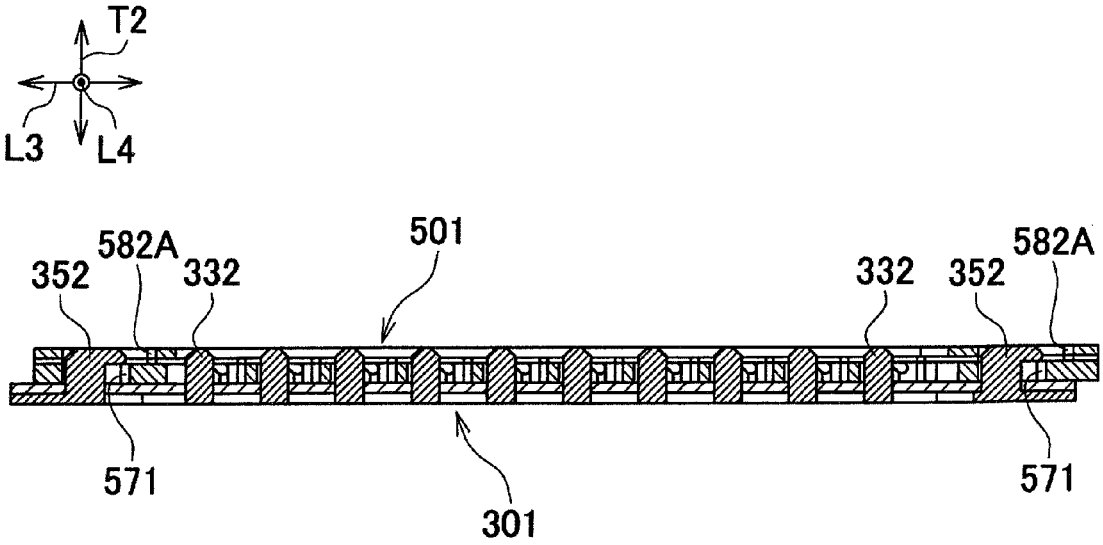
FIG. 16 is a cross-sectional view taken along XVI-XVI in FIG. 15, with the shape of the front ends of the male-side contacts illustrated in a simplified manner.

First, as shown in FIGS. 1 and 14, the female connector 501 and the male connector 301 are disposed opposed to each other, and then, the male connector 301 is relatively moved up in the thickness direction T2 to thereby fit the male connector 301 to the female connector 501 as shown in FIGS. 15, 16, and 17. At this time, the protruding portions 352 of the male connector 301 are inserted in the protruding portion-receiving holes 571 and the through holes 582A of the female connector 501, respectively. Further, each of the male-side contact portions 332 of the male connector 301 is inserted into a contact portion outside area formed by a portion of the first supporting portion 532A2 closer to the first contact point portion 532A3 and a portion of the second supporting portion 532B2 closer to the second contact point portion 532B3 of each female-side contact portion 532, and the arm portion 532A1 of the first supporting portion 532A2 of another adjacent female-side contact portion 532 (adjacent to the left, as viewed in FIG. 17), through an associated one of the through holes 512 (see FIGS. 18 and 19). At this time, the first and second connection portions 532A and 532B are hardly elastically deformed. Note that in the present embodiment, a space outside each female-side contact portion 532 (the above-mentioned contact portion outside area), created by employing a shape which extends toward the central portion of the arm portion 532A1, as the shape of each of the first and second supporting portions 532A2 and 532B2 thereof, is made use of as a space for inserting an associated one of the male-side contact portions 332.

Next, the male connector 301 is relatively slid in the longitudinal direction L3 with respect to the female connector 501 from the protruding portion insertion completion position shown in FIG. 17 to the sliding completion position (see FIGS. 20 to 23). At this time, the associated one of the male-side contact portions 332 enters the inside of the female-side contact portion 532 from the outside of the female-side contact portion 532 (see FIG. 22), and is moved farther away from the arm portion 532A1 of the adjacent female-side contact portion 532. The male-side contact portion 332 is fitted in between the first and second contact point portions 532A3 and 532B3 of the first and second connection portions 532A and 532B, whereby the returning forces of the first and second supporting portions 532A2 and 532B2 are generated, whereby the male-side contact portion 332 is positively sandwiched by the first and second contact point portions 532A3 and 532B3 in the width direction L4.

Figure 23:
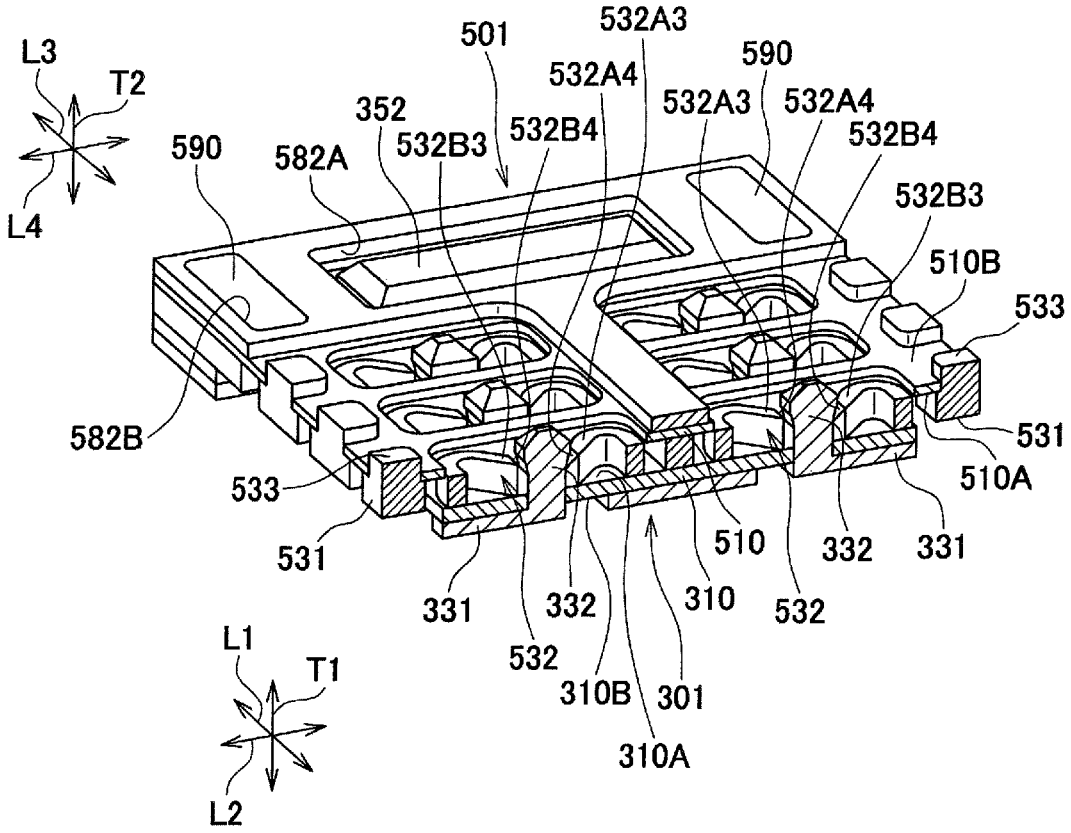
FIG. 23 is a perspective view of the board-to-board connector shown in FIG. 20, in a state cut along XXIII-XXIII in FIG. 20.

As shown in FIG. 23, the first and second contact point portions 532A3 and 532B3 of the female-side contact portion 532 are sandwiched by the front end portion of the male-side contact portion 332 and the male-side insulating film 310 in the thickness direction T1, and hence the contact stability of the female-side contact portion 532 and the male-side contact portion 332 is improved.

According to the present embodiment, the structure has been employed in which when the male connector 301 and the female connector 501 are fitted to each other as described above, first, the male-side contact portion 332 is inserted into the outside of the female-side contact portion 532 (see FIGS. 15 and 17), and then is entered from the outside of the female-side contact portion 532 into the inside thereof, which dispenses with a large space for receiving the male-side contact portion 332 and causing the same to move inside the female-side contact portion 532. This makes it possible to reduce the dimension of each female-side contact portion 532 in the longitudinal direction L3, and hence possible to reduce the size of each female-side contact 530, whereby it is possible to downsize the female connector 501.

Figure 27:
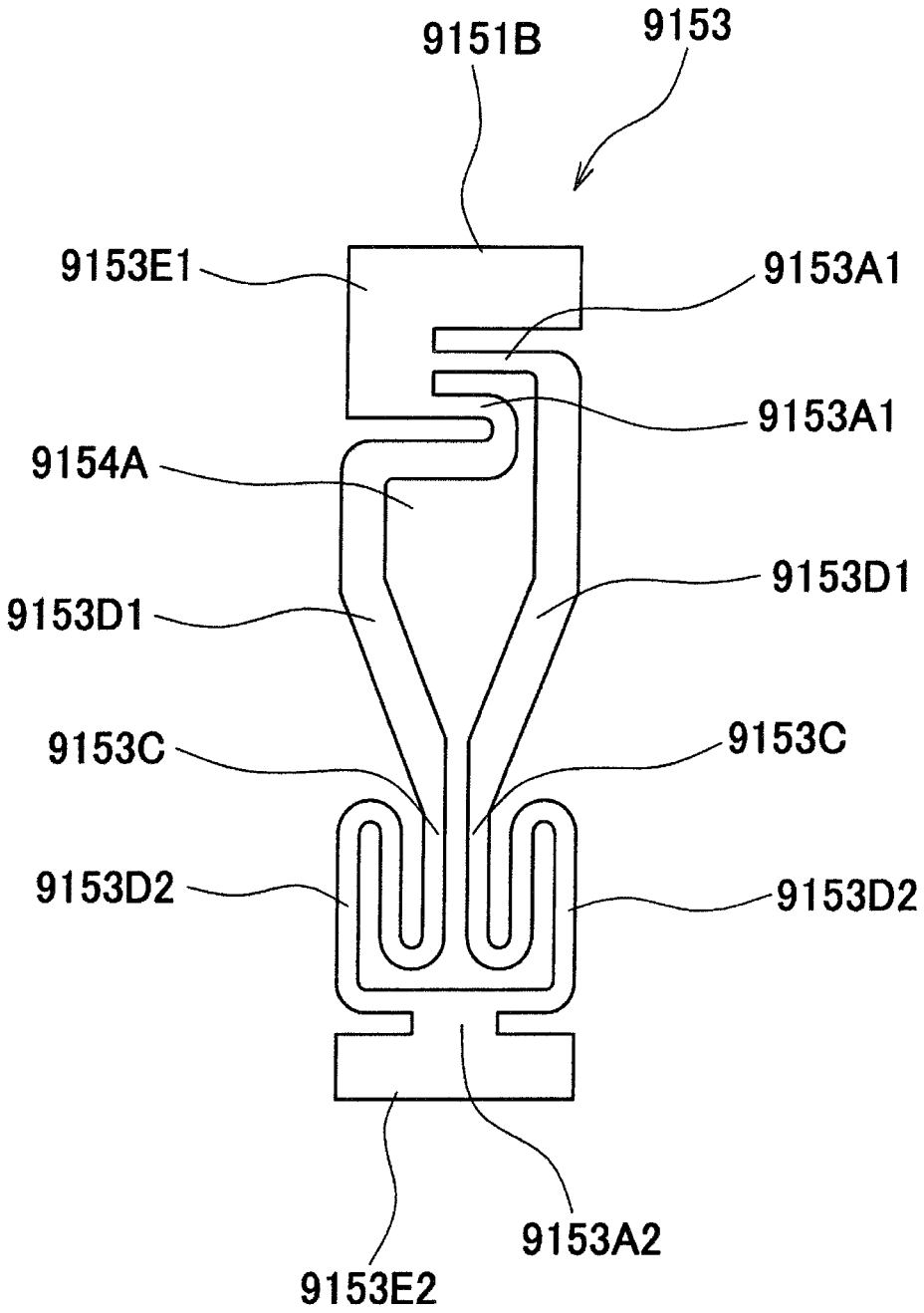
FIG. 27 is a plan view of a reception terminal of a narrow trace of a female connector shown in FIG. 26.

Further, as described above and as shown in FIG. 5, each female-side contact portion 532 is comprised of the first connection portion 532A that includes the arm portion 532A1 extending from an associated one of the base portions 531 in the width direction L4, the first supporting portion 532A2 that is integrally connected to one end of the arm portion 532A1, and the first contact point portion 532A3 formed at the free end of the first supporting portion 532A2, and the second connection portion 532B that includes the second supporting portion 532B2 integrally connected to the other end of the arm portion 532A1, and the second contact point portion 532B3 formed at the free end of the second supporting portion 532B2. The first and second supporting portions 532A2 and 532B2 each have a shape that extends in the direction away from the arm portion 532A1 and then extends toward the central portion of the arm portion 532A1. As described above, since the female-side contact portion 532 has a simpler construction than the prior art shown in FIG. 27, it can be manufactured more easily.

Although in the first embodiment, the first and second supporting portions 532A2 and 532B2 are formed such that they are each generally V-shaped, in plan view, this is not limitative, but the first and second supporting portions 532A2 and 532B2 may each have any other shape, such as an arc shape, insofar as it is a shape that positively sandwiches the male-side contact portion 332. Further, although the arm portion 532A1 is straight in plan view, the arm portion 532A1 is not required to be straight, but it may be curved, for example. Further, although the arm portion 532A1 extends in the width direction L4 orthogonal to the longitudinal direction L3 and the thickness direction T2, the arm portion 532A1 may be extended in a direction obliquely intersecting with the longitudinal direction L3 and the thickness direction T2.

Further, although in the first embodiment, the male-side contact portion 332 is configured to be sandwiched by the first and second contact point portions 532A3 and 532B3 of each female-side contact 530 in the width direction L4 of the female-side insulating film 510, intersecting at right angles with the longitudinal direction L3 of the female-side insulating film 510 and the thickness direction T2 thereof, the direction sandwiching the male-side contact portion 332 may be the direction intersecting obliquely with the longitudinal direction L3 and the thickness direction T2 of the female-side insulating film 510.

Next, female-side contacts of a female connector according to a second embodiment of the present invention will be described with reference to FIGS. 24 and 25.

The female connector according to the second embodiment differs from the female connector 501 according to the first embodiment only in the female-side contacts 2530 and has the same construction as that of the female connector 501 according to the first embodiment except the female-side contacts 2530, and hence a description thereof is omitted.

Further, a male connector combined with the female connector according to the second embodiment is identical to the male connector 301 shown in FIG. 1 except the shape of pin-shaped male-side contact portions of male-side contacts thereof and the like.

Figure 24:
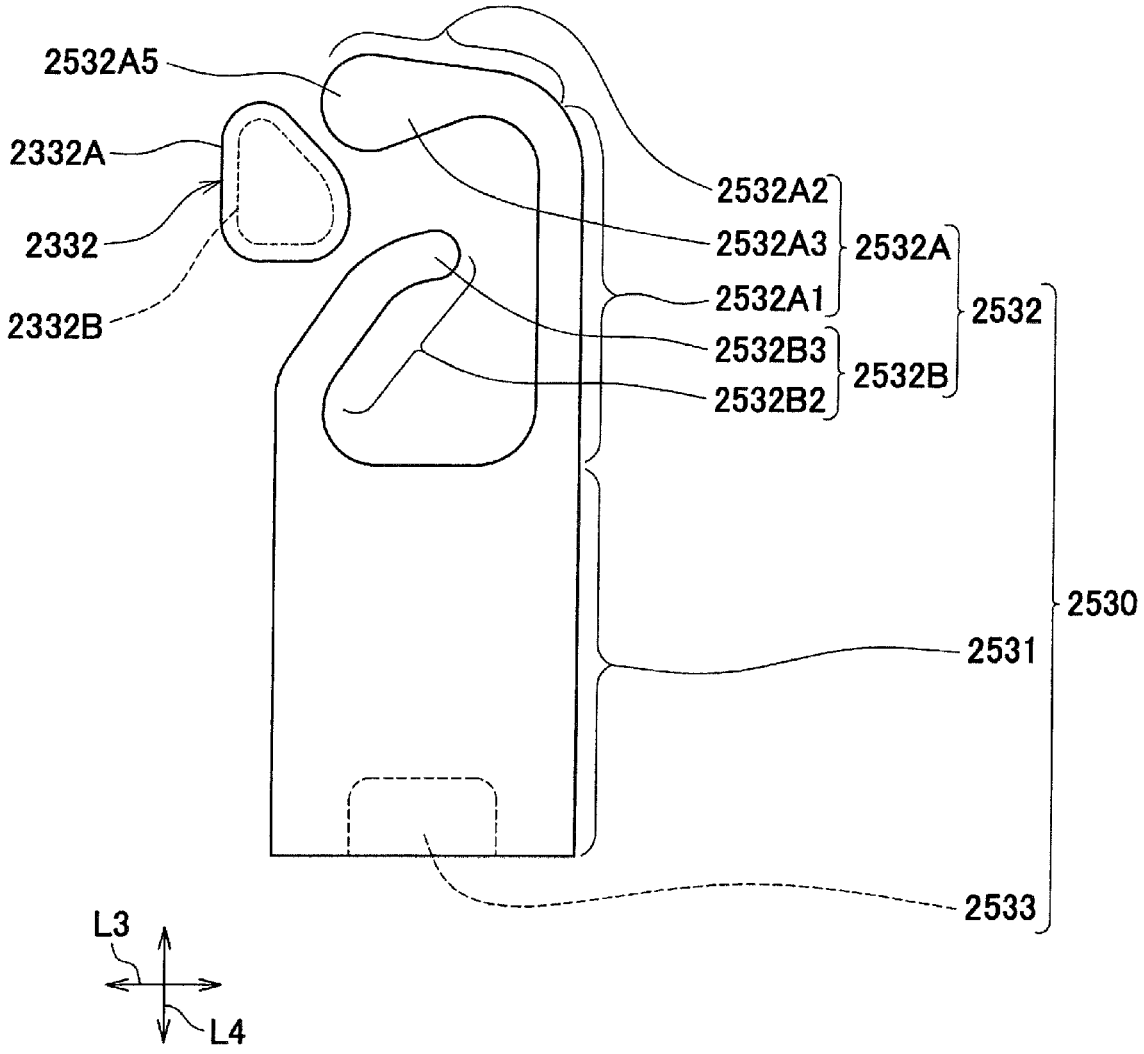
FIG. 24 is a plan view of a female-side contact different from the female-side contact of the female connector according to the first embodiment of the present invention, in a state before a female-side contact portion of the female-side contact is brought into contact with a male-side contact portion.
Figure 25:
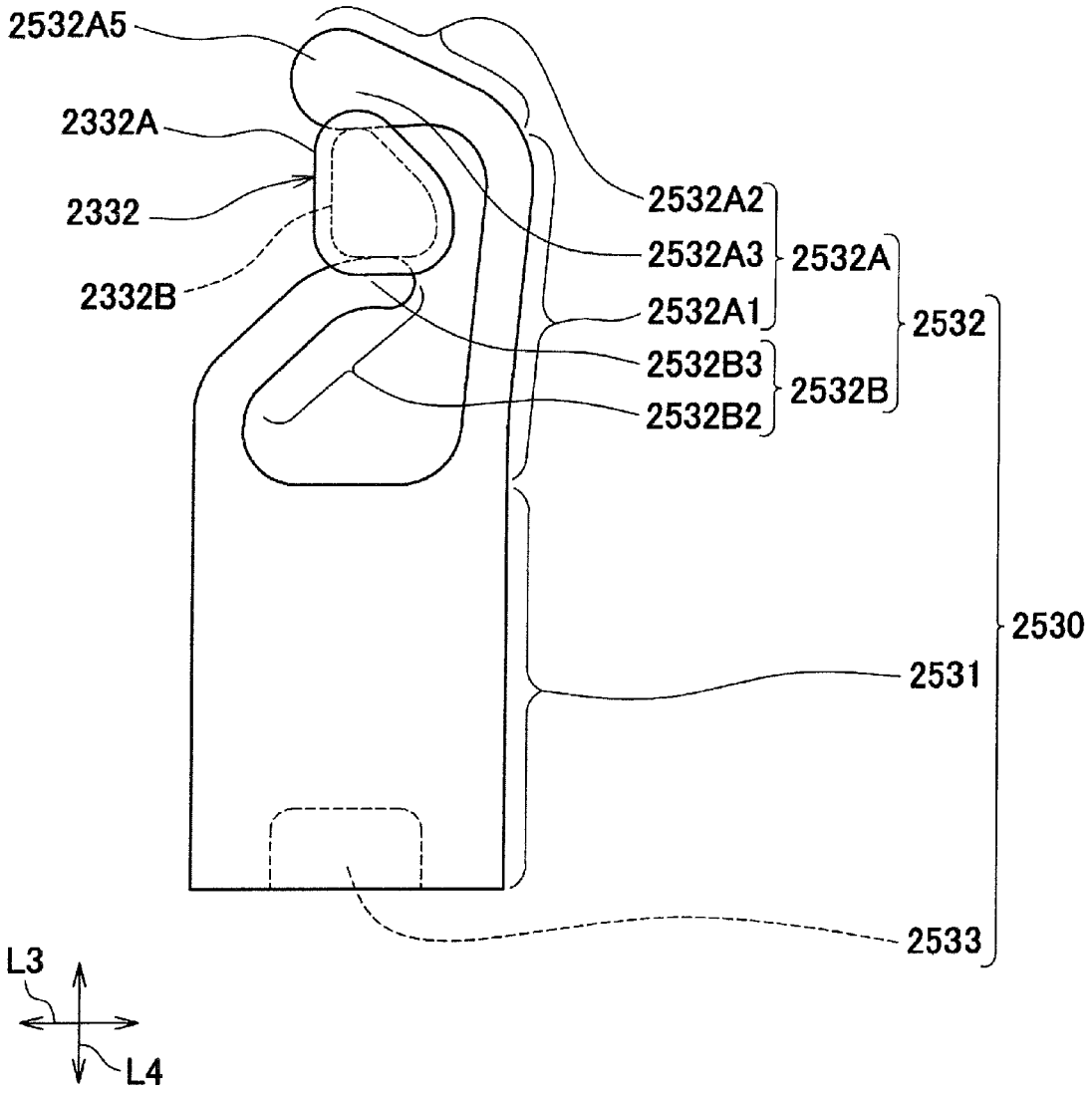
FIG. 25 is a view of the female-side contact portion of the female-side contact and the male-side contact portion shown in FIG. 24 in a state in which the former is in contact with the latter.
Figure 26:
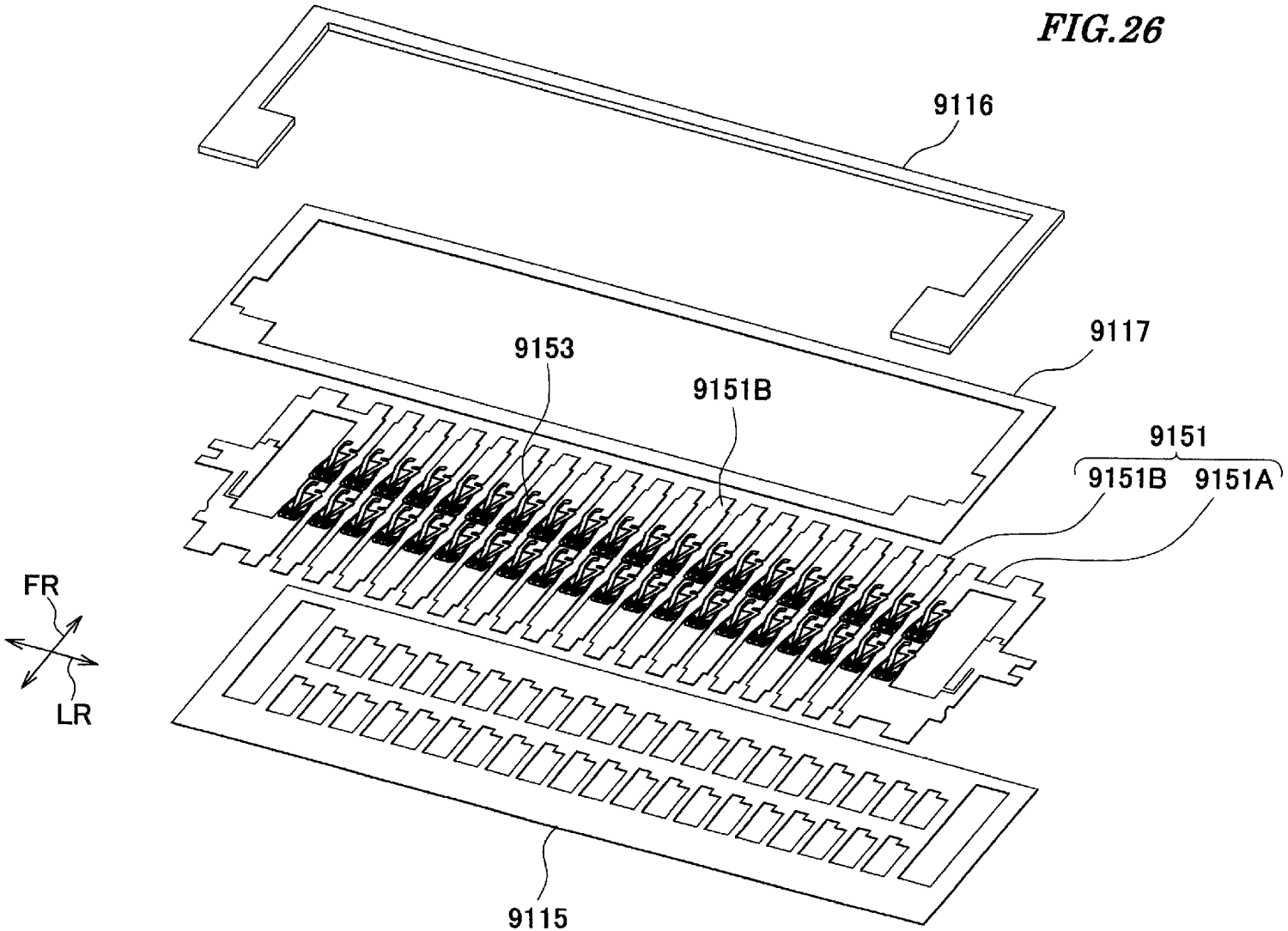
FIG. 26 is an exploded perspective view of a conventional female connector.

As shown in FIGS. 24 and 25, the male-side contact portion 2332 includes a head portion 2332A and a body portion 2332B. A flat surface of the head portion 2332A is next larger than a cross-sectional surface of the body portion 2332B. The body portion 2332B has a substantially triangular shape in cross section.

The female-side contacts 2530 each include a base portion 2531 that is disposed on the one surface 510A of the female-side insulating film 510, a female-side contact portion 2532 that is disposed on the one surface 510A of the female-side insulating film 510, and a female-side terminal portion 2533 that is disposed on the other surface 510B of the female-side insulating film 510. The female-side contact portion 2532 and the female-side terminal portion 2533 are integrally connected to the rectangular base portion 2531.

The female-side contact portion 2532 has a first connection portion 2532A which is generally L-shaped and a second connection portion 2532B which is generally arc-shaped. The first connection portion 2532A has an arm portion 2532A1 that extends in the width direction L4 from one end of the base portion 2531 in the longitudinal direction L3, a first supporting portion 2532A2 that is integrally connected to one end of the arm portion 2532A1 and extends in a direction away from the arm portion 2532A1, a first contact point portion 2532A3 formed on a free end of the first supporting portion 2532A2, and a guiding portion 2532A5 formed at a location adjacent to the first contact point portion 2532A3. The first contact point portion 2532A3 is located closer to the arm portion 2532A1 than the guiding portion 2532A5.

The guiding portion 2532A5 guides the body portion 2332B of the male-side contact portion 2332 between the first contact point portion 2532A3 and a second contact point portion 2532B3 referred to below.

The second connection portion 2532B has a second supporting portion 2532B2 that extends from the other end of the base portion 2531 in the longitudinal direction L3 toward the arm portion 2532A1, and the second contact point portion 2532B3 formed at a free end of the second supporting portion 253282.

When the male-side contact portion 2332 is moved from the outside of the female-side contact portion 2532 (see FIG. 24) to a location between the first contact point portion 2532A3 and the second contact point portion 2532B3 (see FIG. 25) in the longitudinal direction L3, the guiding portion 2532A5 guides the body portion 2332B of the male-side contact portion 2332 in between the first contact point portion 2532A3 and the second contact point portion 2532B3.

The second embodiment provides the same advantageous effects as provided by the first embodiment.

Note that the shapes of the male-side contact portions 332 and 2332 are not limited to a triangular prism or a square prism, but the male-side contact portions 332 are only required to have a pin shape including an arc shape.

Further, although in the above-described embodiments, the male-side contact portions 332 and 2332 are sandwiched by the female-side contact portions 532 and 2532 in the width direction L4 of the female-side insulating film 510, and the male connector 301 can be relatively slid with respect to the female connector 501 in the longitudinal direction L3 of the female-side insulating film 510, the connector sliding direction of the male connector 301 is not limited to this, but for example, the male connector 301 may be relatively slid with respect to the female connector 501 in the width direction L4 of the female-side insulating film 510. However, in this case, the female-side contact portions 532 and 2532 are configured such that they receive the male-side contact portions 332 and 2332 in the width direction L4 of the female-side insulating film 510, and the first and second contact point portions 532A3, 2532A3, 532B3, and 2532B3 are configured such that they sandwich the male-side contact portions 332 and 2332 in the longitudinal direction L3.

It is further understood by those skilled in the art that the foregoing are the preferred embodiments of the present invention, and that various changes and modification may be made thereto without departing from the spirit and scope thereof.

What is claimed is:

1. A female connector that is mounted on a first substrate, and is electrically connected to a male connector mounted on a second substrate by being relatively slid with respect to the male connector, comprising:

a female-side insulating film; and a plurality of female-side contacts that are provided on said female-side insulating film, and each include:

a base portion that is disposed on one surface of said female-side insulating film;

a female-side contact portion that is disposed on the one surface of said female-side insulating film, and is integrally connected to said base portion; and a female-side terminal portion that is disposed on the other surface of said female-side insulating film, and is integrally connected to said base portion, for being connected to the first substrate, wherein said female-side contact portion includes a first connection portion having a first contact point portion that is brought into contact with an associated one of male-side contact portions of the male connector, and a second connection portion having a second contact point portion that is brought into contact with the male-side contact portion, wherein said first connection portion and said second connection portion are formed such that said first contact point portion and said second contact point portion are close to each other, respectively, to thereby make narrow a contact portion inside area formed between said first connection portion and said second connection portion, and wherein the male-side contact portion is sandwiched by said first contact point portion and said second contact point portion, when the male-side contact portion is moved in a connector sliding direction from outside said female-side contact portion to a location between said first contact point portion and said second contact point portion.

2. The female connector according to claim 1, wherein a direction in which the male-side contact portion is sandwiched by said first contact point portion and said second contact point portion is an intersecting direction intersecting at right angles with the connector sliding direction and a thickness direction of said female-side insulating film.

3. The female connector according to claim 1, wherein a direction in which the male-side contact portion is sandwiched by said first contact point portion and said second contact point portion is an intersecting direction intersecting obliquely with the connector sliding direction and a thickness direction of said female-side insulating film.

4. The female connector according to claim 2, wherein when the male-side contact portion is sandwiched by said first contact point portion and said second contact point portion, the male-side contact portion, said first contact point portion, said second contact point portion, and said base portion are aligned in the intersecting direction.

5. The female connector according to claim 3, wherein when the male-side contact portion is sandwiched by said first contact point portion and said second contact point portion, the male-side contact portion, said first contact point portion, said second contact point portion, and said base portion are aligned in the intersecting direction.

6. The female connector according to claim 2, wherein said first connection portion has an arm portion that extends from said base portion in the intersecting direction, and a first supporting portion that is integrally connected to one end of said arm portion, and extends in a direction away from said arm portion, thereafter extending toward a central portion of said arm portion, wherein said first contact point portion is formed at said first supporting portion, wherein said second connection portion has a second supporting portion that is integrally connected to the other end of said arm portion, and extends in a direction away from the arm portion, thereafter extending toward the central portion of said arm portion, and wherein said second contact point portion is formed at said second supporting portion.

7. The female connector according to claim 3, wherein said first connection portion has an arm portion that extends from said base portion in the intersecting direction, and a first supporting portion that is integrally connected to one end of said arm portion, and extends in a direction away from said arm portion, thereafter extending toward a central portion of said arm portion, wherein said first contact point portion is formed at said first supporting portion, wherein said second connection portion has a second supporting portion that is integrally connected to the other end of said arm portion, and extends in a direction away from the arm portion, thereafter extending toward the central portion of said arm portion, and wherein said second contact point portion is formed at said second supporting portion.

8. The female connector according to claim 2, wherein said first connection portion has an arm portion that extends in the intersecting direction from one end of said base portion in the connector sliding direction, and a first supporting portion that is integrally connected to one end of said arm portion, and extends in a direction away from the arm portion, wherein said first contact point portion is formed at said first supporting portion, wherein said second connection portion has a second supporting portion that extends toward said arm portion from the other end of said base portion in the connector sliding direction, and wherein said second contact point portion is formed at said second supporting portion.

9. The female connector according to claim 3, wherein said first connection portion has an arm portion that extends in the intersecting direction from one end of said base portion in the connector sliding direction, and a first supporting portion that is integrally connected to one end of said arm portion, and extends in a direction away from the arm portion, wherein said first contact point portion is formed at said first supporting portion, wherein said second connection portion has a second supporting portion that extends toward said arm portion from the other end of said base portion in the connector sliding direction, and wherein said second contact point portion is formed at said second supporting portion.

10. The female connector according to claim 8, wherein a guiding portion is formed at said first supporting portion, for guiding the male-side contact portion in between said first contact point portion and said second contact point portion when the male-side contact portion is moved in the connector sliding direction from outside said female-side contact portion to a location between said first contact point portion and said second contact point portion.

11. The female connector according to claim 9, wherein a guiding portion is formed at said first supporting portion, for guiding the male-side contact portion in between said first contact point portion and said second contact point portion when the male-side contact portion is moved in the connector sliding direction from outside said female-side contact portion to a location between said first contact point portion and said second contact point portion.

12. The female connector according to claim 2, wherein said female-side insulating film has a through hole that receives the male-side contact portion, and wherein the male-side contact portion is inserted into said through hole.

13. The female connector according to claim 3, wherein said female-side insulating film has a through hole that receives the male-side contact portion, and wherein the male-side contact portion is inserted into said through hole.

14. The female connector according to claim 2, wherein when the male-side contact portion is sandwiched by said first contact point portion and said second contact point portion, said female-side contact portion is sandwiched by a front end portion, which is made thicker, of the male-side contact portion and said male-side insulating film of the male connector in a thickness direction of said female-side insulating film.

15. The female connector according to claim 3, wherein when the male-side contact portion is sandwiched by said first contact point portion and said second contact point portion, said female-side contact portion is sandwiched by a front end portion, which is made thicker, of the male-side contact portion and said male-side insulating film of the male connector in a thickness direction of said female-side insulating film.

16. The female connector according to claim 14, wherein said female-side contact portion has an inclined surface that forms a receiving space for the front end portion of the male-side contact portion when the male-side contact portion is sandwiched by said first contact point portion and said second contact point portion.

17. The female connector according to claim 15, wherein said female-side contact portion has an inclined surface that forms a receiving space for the front end portion of the male-side contact portion when the male-side contact portion is sandwiched by said first contact point portion and said second contact point portion.

18. A method of manufacturing the female connector according to claim 12, comprising:

a thin film-processing step of providing a metal thin film on one surface of said female-side insulating film;

a patterning step of forming a plurality of said female-side contact portions and a plurality of said base portions by etching said metal thin film on the one surface of said female-side insulating film, after execution of said thin film-processing step;

a cutout and through hole-forming step of forming cutouts reaching said base portions in said female-side insulating film and said through holes, by etching processing, after execution of said patterning step; and a terminal portion-forming step of forming a plurality of said female-side terminal portions at respective locations corresponding to the cutouts on the other surface of said female-side insulating film, after execution of said cutout and through hole-forming step.

19. A method of manufacturing the female connector according to claim 13, comprising:

a thin film-processing step of providing a metal thin film on one surface of said female-side insulating film;

a patterning step of forming a plurality of said female-side contact portions and a plurality of said base portions by etching said metal thin film on the one surface of said female-side insulating film, after execution of said thin film-processing step;

a cutout and through hole-forming step of forming cutouts reaching said base portions in said female-side insulating film and said through holes, by etching processing, after execution of said patterning step; and a terminal portion-forming step of forming a plurality of said female-side terminal portions at respective locations corresponding to the cutouts on the other surface of said female-side insulating film, after execution of said cutout and through hole-forming step.

* * * * *